US012127579B2

(12) United States Patent
Rousseau et al.

(10) Patent No.: US 12,127,579 B2
(45) **Date of Patent: *Oct. 29, 2024**

(54) RECONSTITUTED CANNABIS MATERIAL FOR GENERATING AEROSOLS

(71) Applicant: SWM Holdings US, LLC, Alpharetta, GA (US)

(72) Inventors: Cedric Rousseau, Le Mans (FR); Cedric Jardin, Le Mans (FR); Doriane Bigot, Le Mans (FR)

(73) Assignee: SWM Holdings US, LLC, Alpharetta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/332,426

(22) Filed: Jun. 9, 2023

(65) Prior Publication Data

US 2023/0345997 A1 Nov. 2, 2023

Related U.S. Application Data

(63) Continuation of application No. 16/788,064, filed on Feb. 11, 2020, now Pat. No. 11,672,271.

(60) Provisional application No. 62/803,883, filed on Feb. 11, 2019.

(51) Int. Cl.
*A24B 15/16* (2020.01)

(52) U.S. Cl.
CPC ..... *A24B 15/165* (2013.01)

(58) Field of Classification Search
CPC ..... A24B 15/165
See application file for complete search history.

(56) References Cited

U.S. PATENT DOCUMENTS

| | | | |
|---|---|---|---|
| 2,418,296 | A | 4/1947 | Frederickson |
| 3,012,914 | A | 12/1961 | Battista et al. |
| 3,100,492 | A | 8/1963 | Schmidt |
| 3,203,432 | A | 8/1965 | Green et al. |
| 3,429,316 | A | 2/1969 | Hess et al. |
| 4,201,228 | A | 5/1980 | Lewinger |
| 4,279,824 | A | 7/1981 | McKinney |
| 4,459,998 | A | 7/1984 | Labbe |
| 4,542,755 | A | 9/1985 | Selke et al. |
| 4,681,126 | A | 7/1987 | Strubel et al. |
| 4,719,929 | A | 1/1988 | Breckwoldt |
| 4,813,438 | A | 3/1989 | Fleming |
| 4,969,477 | A | 11/1990 | Yagisawa |
| 4,987,906 | A | 1/1991 | Young et al. |
| 5,119,836 | A | 6/1992 | White |
| 5,135,010 | A | 8/1992 | Fan |
| 5,143,097 | A | 9/1992 | Sohn et al. |
| 5,159,942 | A | 11/1992 | Brinkley et al. |
| 5,203,355 | A | 4/1993 | Clearman et al. |
| 5,322,076 | A | 6/1994 | Brinkley et al. |
| 5,323,791 | A | 6/1994 | Wu et al. |
| 5,325,877 | A | 7/1994 | Young et al. |
| 5,339,838 | A | 8/1994 | Young et al. |
| 5,377,698 | A | 1/1995 | Litzinger et al. |
| 5,501,237 | A | 3/1996 | Young et al. |
| 5,513,663 | A | 5/1996 | Van Leuven et al. |
| 5,533,530 | A | 7/1996 | Young et al. |
| 5,562,108 | A | 10/1996 | Hardy et al. |
| 5,715,844 | A | 2/1998 | Young et al. |
| 5,908,034 | A | 6/1999 | Adedeji |
| 6,289,897 | B1 | 9/2001 | McAdam et al. |
| 6,679,270 | B2 | 1/2004 | Baskevitch et al. |
| 6,699,288 | B2 | 3/2004 | Moret |
| 7,323,197 | B1 | 1/2008 | Lukacs |
| 7,428,905 | B2 | 9/2008 | Mua |
| 7,836,896 | B2 | 11/2010 | Nadimi |
| 8,047,209 | B2 | 11/2011 | May |
| 8,469,038 | B2 | 6/2013 | Sinclair, Jr. |
| 8,646,461 | B2 | 2/2014 | Bostel et al. |
| 8,813,760 | B2 | 8/2014 | May, Jr. |
| 8,897,628 | B2 | 11/2014 | Conley et al. |
| 9,022,041 | B2 | 5/2015 | Marsi |
| 9,095,173 | B2 | 8/2015 | Sinclair, Jr. |
| 9,220,298 | B1 | 12/2015 | En'Wezoh et al. |
| 9,428,757 | B2 | 8/2016 | Senger et al. |
| 9,433,240 | B2 | 9/2016 | Sinclair, Jr. |

(Continued)

FOREIGN PATENT DOCUMENTS

| | | |
|---|---|---|
| CN | 1179922 | 4/1998 |
| CN | 103161091 | 6/2013 |

(Continued)

OTHER PUBLICATIONS

U.S. Appl. No. 10/178,872, filed Jan. 15, 2019, Mompon.

(Continued)

*Primary Examiner* — Cynthia Szewczyk

(74) *Attorney, Agent, or Firm* — Dority & Manning, P.A.

(57) ABSTRACT

An aerosol generating material is disclosed containing a reconstituted cannabis material. The reconstituted material can contain extracted cannabis fibers in combination with web building fibers, such as softwood fibers. The reconstituted cannabis material is capable of generating an aerosol, such as a smoke, that can have a conventional cannabis taste with reduced amounts of irritants and harsh components. In one embodiment, the reconstituted cannabis material is formed from plants that are low in cannabinoids, such as THC. Cannabinoids, such as THC and/or CBD, can then be topically applied to the reconstituted plant material for not only controlling the amount of cannabinoids contained in an aerosol generated by the material but also for producing consistent and uniform deliveries.

21 Claims, No Drawings

(56) References Cited

U.S. PATENT DOCUMENTS

| | | | |
|---|---|---|---|
| 9,462,829 | B2 | 10/2016 | Van Den Berg |
| 9,474,725 | B1 | 10/2016 | Reillo et al. |
| 9,532,593 | B2 | 1/2017 | Turner |
| 9,655,381 | B2 | 5/2017 | Sinclair, Jr. |
| 9,675,103 | B2 | 6/2017 | Sinclair, Jr. |
| 9,839,612 | B2 | 12/2017 | Reillo et al. |
| 9,956,911 | B2 | 5/2018 | Wright |
| 9,972,680 | B2 | 5/2018 | Reillo et al. |
| 9,974,739 | B2 | 5/2018 | Reillo et al. |
| 10,016,360 | B1 | 7/2018 | Elbogen et al. |
| 10,076,135 | B2 | 9/2018 | Lisauskas et al. |
| 10,080,385 | B2 | 9/2018 | Sinclair |
| 10,165,795 | B2 | 1/2019 | O'Malley |
| 10,172,897 | B2 | 1/2019 | Vu et al. |
| 10,206,427 | B2 | 2/2019 | Pijnenberg et al. |
| 10,226,066 | B2 | 3/2019 | Moldoveanu et al. |
| 10,271,578 | B2 | 4/2019 | John et al. |
| 10,639,439 | B2 | 5/2020 | Larson |
| 10,729,662 | B2 | 8/2020 | Ragot et al. |
| 10,750,773 | B2 | 8/2020 | Yang et al. |
| 2004/0103908 | A1 | 6/2004 | Prakash et al. |
| 2005/0034739 | A1 | 2/2005 | Dittrich et al. |
| 2005/0263165 | A1 | 12/2005 | Oh et al. |
| 2006/0021626 | A1 | 3/2006 | Mua |
| 2006/0185684 | A1 | 8/2006 | Albino et al. |
| 2008/0000488 | A1 | 1/2008 | Nadimi et al. |
| 2009/0050165 | A1 | 2/2009 | Murali |
| 2010/0187143 | A1 | 7/2010 | Essen et al. |
| 2012/0095088 | A1 | 4/2012 | Hospodor |
| 2012/0152264 | A1 | 6/2012 | Coleman et al. |
| 2012/0318286 | A1 | 12/2012 | Lisauskas et al. |
| 2014/0166028 | A1 | 6/2014 | Fuisz et al. |
| 2014/0216481 | A1 | 8/2014 | Freeman |
| 2014/0295049 | A1 | 10/2014 | Ragot et al. |
| 2014/0360520 | A1 | 12/2014 | May |
| 2015/0037389 | A1 | 2/2015 | Ragot et al. |
| 2015/0068544 | A1 | 3/2015 | Moldoveanu et al. |
| 2015/0083142 | A1 | 3/2015 | Sinclair, Jr. |
| 2015/0107614 | A1 | 4/2015 | Sinclair, Jr. |
| 2015/0374030 | A1 | 12/2015 | Lisauskas et al. |
| 2016/0029690 | A1 | 2/2016 | Sinclair |
| 2016/0037823 | A1 | 2/2016 | Ruben |
| 2016/0193266 | A1 | 7/2016 | Ablett |
| 2016/0205993 | A1 | 7/2016 | Borjessen et al. |
| 2016/0255854 | A1 | 9/2016 | Rousseau |
| 2016/0302474 | A1 | 10/2016 | Chen et al. |
| 2016/0366926 | A1 | 12/2016 | Uren |
| 2017/0035095 | A1 | 2/2017 | Zuchuat et al. |
| 2017/0112187 | A1 | 4/2017 | Ostrander |
| 2017/0112188 | A1 | 4/2017 | Ostrander |
| 2017/0112189 | A1 | 4/2017 | Stern |
| 2017/0119039 | A1 | 5/2017 | Dena et al. |
| 2017/0172201 | A1 | 6/2017 | Turner |
| 2017/0174404 | A1 | 6/2017 | Ragot et al. |
| 2017/0181466 | A1 | 6/2017 | Batista |
| 2017/0188623 | A1 | 7/2017 | Cranford |
| 2017/0202895 | A1 | 7/2017 | Hugh |
| 2017/0202896 | A1 | 7/2017 | Hugh |
| 2017/0245542 | A1 | 8/2017 | Zappoli |
| 2017/0258128 | A1 | 9/2017 | Lisauskas et al. |
| 2017/0273347 | A1 | 9/2017 | Klipfel et al. |
| 2017/0273349 | A1 | 9/2017 | Moore |
| 2017/0303576 | A1 | 10/2017 | Rousseau |
| 2017/0333503 | A1 | 11/2017 | Ayres |
| 2017/0347699 | A1 | 12/2017 | Sinclair, Jr. |
| 2018/0027869 | A1 | 2/2018 | Scott |
| 2018/0116276 | A1 | 5/2018 | Prog et al. |
| 2018/0137792 | A1 | 5/2018 | Gransaull |
| 2018/0168224 | A1 | 6/2018 | Naughton et al. |
| 2018/0177231 | A1 | 6/2018 | Woodbine et al. |
| 2018/0213838 | A1 | 8/2018 | Richmond et al. |
| 2018/0233558 | A1 | 8/2018 | Reillo et al. |
| 2018/0271826 | A1 | 9/2018 | Sievers et al. |
| 2018/0279666 | A1 | 10/2018 | Aoun et al. |
| 2018/0325972 | A1 | 11/2018 | Moore |
| 2018/0344790 | A1 | 12/2018 | Vu et al. |
| 2018/0352848 | A1 | 12/2018 | Vu et al. |
| 2018/0360099 | A1 | 12/2018 | Ibrahim |
| 2018/0360103 | A1 | 12/2018 | Kaplan et al. |
| 2019/0022158 | A1 | 1/2019 | Greenbaum et al. |
| 2019/0145050 | A1 | 5/2019 | Rousseau et al. |
| 2019/0262304 | A1 | 8/2019 | Townsend et al. |
| 2019/0380377 | A1 | 12/2019 | Rabes |
| 2020/0035118 | A1 | 1/2020 | Pandolfino |
| 2020/0054064 | A1 | 2/2020 | Ajithkumar et al. |
| 2020/0101013 | A1 | 4/2020 | Ragot et al. |
| 2020/0108018 | A1 | 4/2020 | Shadurin et al. |
| 2020/0138090 | A1 | 5/2020 | Deforel et al. |
| 2020/0179269 | A1 | 6/2020 | Tamir et al. |
| 2020/0197639 | A1 | 6/2020 | Larson |
| 2020/0205463 | A1 | 7/2020 | Lamblin |
| 2020/0236989 | A1 | 7/2020 | Prince et al. |
| 2020/0253266 | A1 | 8/2020 | Rousseau et al. |
| 2020/0253267 | A1 | 8/2020 | Rousseau et al. |
| 2020/0253268 | A1 | 8/2020 | Rousseau et al. |
| 2020/0253269 | A1 | 8/2020 | Rousseau et al. |
| 2020/0275688 | A1 | 8/2020 | Rousseau et al. |
| 2020/0297023 | A1 | 9/2020 | Billon et al. |

FOREIGN PATENT DOCUMENTS

| | | | |
|---|---|---|---|
| CN | 103704882 | | 4/2014 |
| EP | 0271036 | | 3/1992 |
| EP | 0336458 | | 11/1994 |
| EP | 0337506 | | 11/1994 |
| EP | 0339689 | | 11/1994 |
| EP | 1797779 | | 6/2006 |
| EP | 1420659 | | 6/2007 |
| IN | 3540DEL2012 | | 12/2012 |
| JP | 2017093297 | A | 6/2017 |
| JP | 2017525422 | A | 9/2017 |
| JP | 2017538410 | A | 12/2017 |
| JP | 2019502366 | A | 1/2019 |
| WO | WO2002047494 | | 6/2002 |
| WO | WO2003020057 | | 3/2003 |
| WO | WO2004043173 | | 5/2004 |
| WO | WO2004068974 | | 8/2004 |
| WO | WO2006097447 | | 9/2006 |
| WO | WO2011127679 | | 10/2011 |
| WO | WO2011127680 | | 10/2011 |
| WO | WO2014106819 | | 7/2014 |
| WO | WO2016026810 | | 2/2016 |
| WO | WO2016050873 | | 4/2016 |
| WO | WO2016171997 | | 10/2016 |
| WO | WO2018143952 | | 8/2018 |
| WO | WO2018178978 | | 10/2018 |
| WO | WO2020/097430 | | 5/2020 |

OTHER PUBLICATIONS

Co pending U.S. Appl. No. 16/998,514, filed Aug. 20, 2020.
Translation of Japanese Office Action Corresponding to Application No. 2021-546668 on Feb. 6, 2024.

RECONSTITUTED CANNABIS MATERIAL FOR GENERATING AEROSOLS

RELATED APPLICATIONS

The present application is based on and claims priority to U.S. patent application Ser. No. 16/788,064, filed on Feb. 11, 2020, which is based on and claims priority to U.S. Provisional Patent Application Ser. No. 62/803,883, filed on Feb. 11, 2019, both of which are incorporated herein by reference.

BACKGROUND

Cannabis, or the cannabis plant, may refer to both marijuana, which is generally used for recreational purposes, and hemp, which is generally used in industrial applications. Cannabis is a green and/or brown mixture of dried, shredded leaves, stems, seeds and flowers of the plant, and may reference leaves, stems, seeds, and flowers from a *Cannabis* plant, varieties of which include *Cannabis sativa* or *Cannabis* indica. Hemp (and particularly the industrial hemp variety), have a very similar appearance to marijuana, but unlike the cannabis plant variety referred to by marijuana, hemp generally only contains low amounts of tetrahydrocannabinol (THC), where both hemp and marijuana can include high amounts of cannabidiol (CBD). For instance, hemp, and particularly industrial hemp may contain less than about 0.3% THC where the cannabis variety referred to by marijuana may contain anywhere from 5% to 30% THC. Cannabis, both marijuana and hemp, is a known pain reliever, however, generally, only hemp, or industrial hemp have been used for food, paper, clothing, fabrics, and CBD extracts, due to their low THC content. Recently, over 25 states in the United States have legalized the use of cannabis for at least medical purposes. In addition, Canada has now legalized the use of cannabis for medical and recreational use. In view of these recent developments, the commercialization of cannabis has dramatically increased.

Cannabis, for instance, is becoming a more and more popular drug for pain relief in lieu of conventional pain relief medicines, such as opioids. Opioids are powerful pain relief medications that relieve pain by acting on the nervous system. They are typically used to treat severe pain after surgery and are also used to treat chronic pain. Unfortunately, however, opioids come with many risks. For example, opioids are highly addictive which has led to an epidemic of drug misuse. In fact, more than 11 million people each year misuse prescription opioids.

In view of the above drawbacks, more and more people in the medical community have begun to view cannabis as a legitimate alternative to the use of opioids for pain relief. Cannabis, for instance, contains two different drugs that can help relieve pain, nausea, and other symptoms. Cannabis contains, for instance, tetrahydrocannabinol (THC). THC acts on specific receptors in the brain which lead to a feeling of euphoria and a relaxed state. The highest concentrations of THC in cannabis is found in the dried flowers or buds. Cannabis is typically regulated based upon the amount of THC found in the material.

In addition to THC, cannabis also can contain cannabidiol (CBD). Although CBD does interact with pain receptors in the brain, CBD does not create the same euphoric feeling caused by THC. CBD, however, exerts pain-relieving and anti-inflammatory effects. Cannabis, and especially CBD, do not have the same addictive effect as many opioids.

Inhaling combusted cannabis is the most common, effective and least expensive method for incorporating THC and CBD into the body. Various problems exist, however, in delivering cannabis to a patient or user through combustion. For example, THC and/or CBD deliveries can vary dramatically depending upon the particular plant and the particular plant parts being burned. Simply rolling cannabis material in a rolling paper, for instance, can lead to drastic non-uniformity differences in delivery based upon many factors including the paper used, packing densities, the parts of the plants used, the manner in which the plants have been prepared, and the like. Non-uniformity differences in delivery can also occur based upon the particular strain of cannabis used to produce the product. In fact, non-uniformity differences in delivery can also occur within the same strain when growing conditions vary from one plant to the next. Further, in addition to THC and CBD, cannabis contains over 60 different cannabinoid compounds and over 400 other different compounds that may give the product a bad taste and/or a harsh smoking experience.

In addition to controlling deliveries, problems have also been experienced in producing smoking articles from cannabis plants using conventional cigarette making machines or machines for making heated tobacco product sticks. Due to the differences in texture, bulk density, and the like, cannabis materials can cause clogging and other interruptions when run on machines designed to process cured tobacco.

In view of the above, a need currently exists for an improved aerosol generating material that can control the delivery of physiologically active compounds in an aerosol generated by the product. In particular, a need exists for an aerosol generating material that can control the delivery of active compounds, such as THC and/or CBD through an aerosol. In addition, a need exists for an aerosol generating material capable of delivering active compounds not only in a uniform and consistent manner, but also at desired levels while also providing an aerosol without any harsh components. In an alternative aspect, a need also exists for a cannabis-based aerosol-generating filler that can be processed on conventional cigarette or heated tobacco product sticks making machines for producing cylindrical rods.

SUMMARY

In general, the present disclosure is directed to an aerosol generating material made from cannabis components. The aerosol generating material may comprise a reconstituted cannabis material that produces an aerosol when heated or burned. The reconstituted cannabis material of the present disclosure is particularly well suited for being treated with active substances for controlling delivery of the active substances to the user. For instance, in one embodiment, the reconstituted cannabis material can be treated with controlled amounts of THC and/or CBD.

In one embodiment, for instance, the present disclosure is directed to an aerosol generating material that comprises a reconstituted cannabis material. The reconstituted cannabis material can contain extracted cannabis fibers obtained from cannabis leaves, cannabis hurds or stems, cannabis buds, cannabis flowers, cannabis seeds, or mixtures thereof. In one aspect, the plant material used to form the reconstituted cannabis material can undergo two different extraction processes. For instance, the reconstituted cannabis material can be formed from biomass created in a first extraction process where selected components are extracted from the plant matter, such as cannabinoids, while leaving a substantial amount of water soluble components within the plant matter. The biomass can then be subjected to a second extraction process where the water soluble components are removed in forming the reconstituted cannabis material.

The extracted cannabis fibers can be combined with web building fibers to produce the reconstituted cannabis material. The web building fibers, for instance, may comprise delignified cellulosic fibers, such as pulp fibers.

In one embodiment, the reconstituted cannabis material includes from about 20% to about 50% by weight extracted cannabis leaves, from about 20% to about 50% by weight extracted cannabis buds and/or flowers, and from about 3% to about 20% by weight delignified cellulosic fibers.

The web building fibers contained in the reconstituted cannabis material may include softwood fibers, hardwood fibers, flax fibers, hemp fibers, abaca fibers, bamboo fibers, coconut fibers, ramie fibers, jute fibers, or mixtures thereof. The web building fibers can be present in the reconstituted cannabis material in an amount greater than about 3% by weight, such as in an amount greater than about 5% by weight, such as in an amount greater than about 8% by weight, and generally in an amount less than about 40% by weight.

In addition to extracted cannabis fibers and web building fibers, in one embodiment, the reconstituted cannabis material may also contain various other plant fibers. For instance, in one embodiment, the reconstituted cannabis material may also contain extracted cocoa husk fibers.

The reconstituted cannabis material, in one embodiment, can further include a humectant, such as glycerol, propylene glycol, or mixtures thereof. In one embodiment, the humectant can be present in the reconstituted cannabis material in an amount of about 5% by weight or less. In an alternative embodiment, the humectant can be present in the reconstituted cannabis material in an amount greater than about 5% by weight, such as in an amount greater than about 10% by weight, such as in an amount greater than about 15% by weight, such as in an amount greater than about 20% by weight, and generally in an amount less than about 50% by weight.

In one embodiment, the reconstituted cannabis material can contain very low levels of THC. For instance, the untreated reconstituted cannabis material can contain less than about 0.3% by weight THC, such as less than about 0.2% by weight THC, such as less than about 0.1% by weight THC. For instance, the reconstituted cannabis material can be formed from industrial hemp. In order to regulate the amounts of THC, THC can then be topically applied to the reconstituted cannabis material for controlling deliveries of THC to the user. In this manner, not only is the amount of THC controlled, but the delivery of THC through the aerosol generating material is consistent and uniform.

In addition to THC, the reconstituted cannabis material of the present disclosure can be treated with various other aerosol delivery compositions containing an aerosol delivery agent. The aerosol delivery agent, for instance, may comprise a drug or a flavorant and may be in the form of an oil or a solid. Aerosol delivery agents that can be applied to the reconstituted cannabis material include other cannabinoids in addition to THC, such as CBD. Still other aerosol delivery agents that can be applied to the reconstituted cannabis material include nicotine, a sugar, a licorice extract, honey, a coffee extract, maple syrup, a tea extract, a plant extract, a botanical extract, a tobacco extract, or a fruit extract. In one aspect, the aerosol delivery agent can comprise one or more terpenes. A terpene or a blend of terpenes can be added to the reconstituted cannabis material in order to impart a distinct aroma that indicates a high quality cannabis product. Terpenes that can be added to the reconstituted cannabis material include pinene, humulene, b-caryophyllene, isopulegol, guaiol, nerylacetate, neomenthylacetate, limonene, menthone, dihydrojasmone, terpinolene, menthol, phellandrene, terpinene, geranylacetate, ocimene, myrcene, 1,4-cineole, 3-carene, linalool, menthofuran, perillyalcohol, pinane, neomenthylaceta, and substantial others.

The aerosol delivery composition can be applied to the reconstituted cannabis material generally in an amount greater than about 0.1% by weight, such as in an amount greater than about 1% by weight, such as in an amount greater than about 3% by weight, such as in an amount greater than about 5% by weight, such as in an amount greater than about 10% by weight, such as in an amount greater than about 15% by weight, such as in an amount greater than about 20% by weight, such as in an amount greater than about 25% by weight, such as in an amount greater than about 30% by weight, such as in an amount greater than about 35% by weight, such as in an amount greater than about 40% by weight, and generally in an amount less than about 50% by weight.

The reconstituted cannabis material can contain water soluble cannabis components generally in an amount less than about 50% by weight, such as in an amount less than about 20% by weight, such as in an amount less than about 10% by weight, such as in an amount less than about 5% by weight. The water soluble cannabis components can be substantially removed from the reconstituted cannabis material or can be reapplied at any desired level.

The reconstituted cannabis material can generally have a basis weight of from about 40 gsm to about 120 gsm, such as from about 55 gsm to about 85 gsm. The reconstituted cannabis material can be treated with a burn control agent or a burn retardant. In order to form a filler material, the reconstituted cannabis material can be in the form of a strip, strips, shreds, or mixtures thereof.

The reconstituted cannabis material of the present disclosure can be used in all different types of applications. For instance, the reconstituted cannabis material can be used in heat but not burn applications to produce an aerosol. Alternatively, the reconstituted cannabis material can be used to produce a smoking article. In still another alternative embodiment, the reconstituted cannabis material can be used to produce a smokeless blend product. When producing a smokeless blend product, web building fibers may not be needed or may be present in relatively small amounts, such as in amounts less than about 5% by weight, such as in amounts less than about 3% by weight. Alternatively, the smokeless blend product (or "snuff") can contain web building fibers in an amount of from 5% to 50% by weight.

Other features and aspects of the present disclosure are discussed in greater detail below.

DEFINITIONS

As used herein, a "reconstituted plant material" refers to a material formed by a process in which a plant feed stock, such as cannabis components, is extracted with a solvent to form an extract of solubles, such as water solubles, and an extracted insoluble portion or residue comprising fibrous material. The extracted and insoluble fibrous material is then formed into a sheet through any suitable process and the extract may either be discarded or reapplied to the formed sheet. The extract can be fed through various processes for concentrating the extract and optionally removing or adding various components prior to being recombined with the fibrous material. In the present disclosure, the reconstituted plant material is formed from extracted cannabis fibers optionally combined with web building fibers, such as cellulose fibers. The extract of solubles obtained from the cannabis fibers is optionally reapplied to the sheet or material.

As used herein, an "aerosol generating material" is meant to include both a combustible material that undergoes combustion in a smoking article and to an aerosol-forming material that is heated but not combusted to form an inhalable aerosol. Combustible smoking articles can include cigarettes, cigarillos and cigars. In a cigarette, the aerosol generating material is surrounded by a wrapping material to form a smokable rod. Aerosol generating devices for generating an aerosol include, for instance, devices in which an aerosol is generated by electrical heating or by the transfer of heat from a combustible fuel element or heat source to heat but not burn the aerosol generating material, which releases volatile compounds. As the released compounds cool, they condense to form an aerosol that is inhaled by the consumer.

As used herein, "extracted cannabis fibers" refers to cannabis fibers that have been subjected to an extraction process in which the cannabis has been contacted with an aqueous solution to remove water soluble components contained in the cannabis. The extraction process is different from a delignification process and from a bleaching treatment.

As used herein, "extracted byproducts" refer to cannabis biomass that has been subjected to an extraction process for removing selected components, such as cannabinoids, without removing a substantial amount of water soluble components. The extracted byproducts can be referred to as biomass resulting from an extraction process where the extractant is a solvent, such as ethanol, a supercritical fluid such as carbon dioxide, a lipid such as a vegetable oil, or the like. Extracted byproducts, in accordance with the present disclosure, can be subjected to a second extraction process for removing water soluble components during the process of making a reconstituted cannabis material. Extracted byproducts well suited for use in the present disclosure include those that contain water soluble components in an amount greater than about 8% by weight, such as in an amount greater than about 12% by weight, such as in an amount greater than about 18% by weight, such as in an amount greater than about 24% by weight.

As used herein, "delignified" cellulosic fibers (e.g. pulp fibers) refers to fibers that have been subjected to a pulping or delignification process by which the cellulose fibers are separated from the plant material through chemical means, mechanical means, or through a combination of chemical and mechanical means.

As used herein, the term "refine" is used to mean that the plant material is subjected to a mechanical treatment that modifies the fibers of the material so that they are better suited to forming a fibrous sheet or substrate. Refining can be accomplished using a conical refiner, disks refiner, or a beater such as a Valley beater. The mechanical process exerts an abrasive and bruising action on the plant material such that the plant material is deformed and declustered. Refining is a different process than delignification and pulping.

As used herein, the term "stalk" is used to refer to the main structural portion of a plant that remains after the leaves have been removed.

As used herein, the term "hurd" is used herein to refer to the structural portion of a plant, e.g. stem) connecting the leaves or laminae to the stalk and also to the veins or ribs that extend through the leaves. The term "hurd" does not encompass the term "stalk" and vice versus.

As used herein, "cannabis" may refer to any variety of the *Cannabis* plant, such as *Cannabis sativa* or *Cannabis* indica, for instance. More particularly, the present disclosure may refer to leaves, stems, seeds and flowers or any other part of the *Cannabis* plant, as cannabis. Nonetheless, cannabis, as referred to herein, includes cannabis that contains average or high levels of THC and/or CBD (usually known as marijuana), hemp, which may contain low, or very low, levels of THC, industrial hemp, which may refer to a cannabis plant that contains less than 0.3% THC, or combinations thereof.

DETAILED DESCRIPTION

It is to be understood by one of ordinary skill in the art that the present discussion is a description of exemplary embodiments only, and is not intended as limiting the broader aspects of the present disclosure.

The present disclosure is generally directed to an aerosol generating material made from cannabis components. More particularly, the present disclosure is directed to a reconstituted cannabis material that produces an aerosol when heated or burned that has a more mild cannabis smell and that is less harsh when inhaled in comparison to conventional cannabis fillers. Of particular advantage, the reconstituted cannabis material of the present disclosure is well suited to acting as a carrier for active substances such as drugs, flavorants, and the like. In one embodiment, for instance, the reconstituted cannabis material can be treated with THC and/or CBD in a manner such that an aerosol generated by the material can deliver the THC and/or CBD to a user in controlled, consistent and uniform amounts.

Due to its lack of irritants and more mild aerosol and taste, the reconstituted cannabis material of the present disclosure is well suited to being combined with other smokable fillers. In addition, as described above, the reconstituted cannabis material is also highly absorbent and can be treated with many different types of topical additives, in addition to THC and CBD.

For example, the reconstituted cannabis material can be combined with tobacco materials for forming an aerosol producing filler that has a tobacco and cannabis taste and smell. In addition to tobacco materials, the reconstituted cannabis material of the present disclosure can also be combined with other aerosol producing fillers, such as herbal blends.

The reconstituted plant material of the present disclosure is generally formed from extracted cannabis components or fibers optionally combined with web building fibers. Cannabis is intended to cover all varieties of the *Cannabis sativa* plant species, whether or not the plant species contains detectable levels of THC. Many species of cannabis, for instance, contain THC. There are, however, cannabis plant strains that are particularly low in THC and typically referred to as industrial hemp. Industrial hemp, for instance, can contain THC in an amount less than about 1% by weight, such as in an amount less than about 0.5% by weight, such as in an amount less than about 0.3% by weight, such as in an amount less than about 0.2% by weight, such as in an amount less than about 0.1% by weight. Cannabis components used to produce a drug for medicinal or recreational use, on the other hand, can contain anywhere from 3% to over 20% by weight THC. Cannabis can be obtained from the plant *Cannabis indica* or from *Cannabis sativa.*

In one embodiment, cannabis plant materials, such as leaves, hurds, buds, flowers, seeds, cannabis residues, byproducts of extraction, and mixtures thereof are optionally sized or ground and then subjected to an extraction process for removing water soluble components. The extracted cannabis can then be combined with web building fibers and formed into a substrate, such as a reconstituted sheet. The substrate can optionally be treated with the extract obtained from the cannabis. Alternatively, the extract obtained from the cannabis can be discarded and not recombined with the water insoluble fibers and other materials. The reconstituted material is then dried and formed into an aerosol generating material, such as a smokable filler. The aerosol generating material can then optionally be combined with various other components. For instance, the material can be treated with various aerosol delivery agents and/or combined with various other aerosol or smoking fillers, such as tobacco materials or other herbal fillers.

The resulting aerosol generating material made in accordance with the present disclosure can then be used in numerous different types of consumer products. For instance, in one embodiment, the aerosol generating material can be incorporated into smoking articles, such as cigarettes, cigarillos, cigars, and the like. Of particular advantage, the reconstituted cannabis material of the present disclosure is well suited for use in conventional cigarette or heated tobacco product sticks making machines. Thus, aerosol producing rods of the material including cigarettes can be rapidly produced having uniform characteristics.

In one embodiment, the aerosol generating material of the present disclosure can be packaged and sold as a loose filler material for use in pipes or to allow consumers to roll their own cigarettes or other smoking articles. In an alternative embodiment, the aerosol generating material of the present disclosure can be incorporated into devices that heat the material without burning the material to produce an aerosol that is inhaled. The aerosol generating material can be cut, shredded, or otherwise processed into a form best suited for the particular application and product.

In forming the reconstituted plant material of the present disclosure, the cannabis components are first collected and optionally reduced in size. The cannabis components can include leaves, hurds, buds, flowers and optionally stalk components. In one embodiment, the cannabis components are obtained from cannabis plants that have a relatively low THC content. For instance, the amount of THC in the cannabis components can be less than about 1% by weight THC, such as less than about 0.3% by weight THC, such as less than about 0.2% by weight THC, such as less than about 0.1% by weight THC. Using cannabis components from low THC plants can offer various advantages and benefits. Producing a reconstituted cannabis material low in THC, for instance, allows for better control over THC deliveries when the THC is topically applied to the material. In addition, a reconstituted material can be produced that contains no detectable amounts of THC so that the material can deliver other active agents, such as CBD, flavorants, nicotine, or the like. It should be understood, however, that in other embodiments the reconstituted cannabis material can be made from THC containing plants, such as from the species *Cannabis indica*.

In one aspect, at least a portion of the cannabis components collected for producing the reconstituted cannabis material are cannabis extracted byproducts. *Cannabis* extracted byproducts include cannabis biomass that has already been subjected to a first extraction process for removing desired components from the plant, but without removing substantial amounts of the water soluble components. For example, the cannabis extracted byproducts can be the biomass that remains after one or more cannabinoids have been extracted from the cannabis plant material, such as THC and/or CBD. These types of extraction processes can use different solvents and supercritical fluids. For example, in one embodiment, the extracted byproducts result from a cannabis extraction process in which the cannabis material is ground and combined with a solvent. The solvent, for instance, can be an alcohol, such as ethanol, an organic ester, a petroleum derived hydrocarbon such as toluene or trimethylpentane, or a lipid, such as a vegetable oil. Examples of vegetable oils include safflower oil, coconut oil, and the like. In an alternative embodiment, during the extraction process, the cannabis plant material can be contacted with a supercritical fluid, such as carbon dioxide. In general, the extraction process includes grinding or cutting the plant material to a desired size and then contacting the material with an extractant, such as a solvent or a supercritical fluid. The material can be heated during contact with the solvent. When contacted with a supercritical fluid, for instance, the temperature can be from about 31° C. to about 80° C. and the pressure can be from about 75 bar to about 500 bar.

Using extracted byproducts as a portion of the cannabis components can provide various advantages. For instance, the cannabis extracted byproducts may produce a milder aerosol and may be in a form that is easier to handle than the virgin plant materials. In order to produce a reconstituted cannabis material, the cannabis extracted byproducts can undergo a second extraction process for removing the water soluble components. The cannabis extracted byproducts, for instance, may contain water soluble components in an amount greater than about 8% by weight, such as in an amount greater than about 12% by weight, such as in an amount greater than about 18% by weight, such as in an amount greater than about 24% by weight, such as in an amount greater than about 28% by weight, and generally in an amount less than about 60% by weight, such as in an amount less than about 50% by weight.

After the cannabis components are collected, the cannabis components can be subjected to a grinding operation, milling operation or beating operation that can reduce the size of the cannabis components and/or reduce the cannabis into individual fibers. For example, in one embodiment, the cannabis materials can be fed to a hammer mill that beats the cannabis materials against a screen for producing a fibrous material. Reducing the size of the cannabis component, however, may not be necessary when using a cannabis extracted byproduct that may have already been subjected to a size reduction extraction step.

After the cannabis is optionally reduced in size, the cannabis is subjected to an extraction process for removing water soluble components. The extraction process can provide various different benefits. For instance, the extraction process can remove constituents contained in the cannabis that are irritants when inhaled through an aerosol. In this manner, the extraction process can dramatically reduce from the aerosol produced by the material various harsh components. In addition, subjecting the cannabis to an extraction process also cleans the plant material and removes any herbicides, pesticides, and/or microorganisms that may be present on the material.

During the extraction process, the cannabis is contacted with a solvent in order to remove the water soluble components. In one embodiment, the solvent comprises only water. In an alternative embodiment, various solvents that are water-miscible, such as alcohols (e.g., ethanol), can be combined with water to form an aqueous solvent. The water content of the aqueous solvent can, in some instances, be greater than 50 wt. % of the solvent, and particularly greater than 90 wt. % of the solvent. Deionized water, distilled water or tap water may be employed. The amount of the solvent in the suspension can vary widely, but is generally added in an amount from about 50 wt. % to about 99 wt. %, in some embodiments from about 60 wt. % to about 95 wt. %, and in some embodiments, from about 75 wt. % to about 90 wt. % of the suspension. However, the amount of solvent can vary with the nature of the solvent, the temperature at which the extraction is to be carried out, and the type of cannabis furnish.

In addition to aqueous solvents, non-aqueous solvents can also be used. The solvent, for instance, can be an oil or a fat. In one embodiment, a multi-phase solvent can be used that includes a combination of water with an oil or fat.

After forming the solvent/cannabis furnish mixture, some or all of a soluble fraction of the furnish mixture may be separated from the mixture. The aqueous solvent/cannabis furnish mixture can be agitated by stirring, shaking or otherwise mixing the mixture in order to increase the rate of solubilization. Typically, the process is carried out for about one-half hour to about 6 hours. Process temperatures may range from about 10° C. to about 100° C., such as from about 40° C. to about 90° C.

After the cannabis materials are soaked in an extractant, the insoluble cannabis material can be mechanically separated from the cannabis liquor or extract using a press. Once the soluble fraction is separated from the cannabis furnish or insoluble fraction, the soluble fraction can be discarded or further processed, such as by being concentrated. The soluble fraction can be concentrated using any known type of concentrator, such as a vacuum evaporator. In one embodiment of the present disclosure, the soluble fraction can be highly concentrated. In one embodiment, for instance, the cannabis soluble fraction can be evaporated so as to have a final brix of from about 10% to about 60%, such as from about 10% to about 50%, such as from about 20% to about 50%, such as from about 15% to about 35%.

The resulting concentrated cannabis soluble fraction may be used in a separate process, or can be later coated onto the reconstituted plant material of the present disclosure as will be described in greater detail below.

The resulting water insoluble cannabis fraction is generally in an unrefined state. The cannabis material can comprise particles and fibers. In one embodiment, the insoluble and extracted cannabis fraction can be subjected to a refining process. For instance, the extracted cannabis material can be fed through any suitable refining device, such as a conical refiner or a disk refiner. Other refining devices that may be used include a beater, such as a Valley beater. Refining can occur while the cannabis materials are moist or after being combined with water. For instance, in one embodiment, refining can occur while the cannabis material is at a consistency of less than about 10%, such as less than about 5%, such as less than about 3%.

In accordance with the present disclosure, the extracted cannabis material can then be combined with web building fibers in forming a fiber substrate, such as a reconstituted plant material. For example, the extracted cannabis can be combined with water or an aqueous solution to form a slurry. The web building fibers, such as delignified cellulosic fibers, can be combined with the cannabis material in forming the slurry. The fiber slurry is then used to form a continuous reconstituted sheet. For example, in one embodiment, the fiber slurry is fed to a papermaking process that can include a forming wire, gravity drain, suction drain, a felt press, and a dryer, such as a Yankee dryer, a drum dryer, or the like. For example, in one embodiment, the fiber slurry is formed into a continuous sheet on a Fourdrinier table. One advantage to combining the extracted cannabis with the cellulosic fibers is that the resulting fiber furnish can be processed on conventional papermaking equipment.

In one embodiment, the fiber slurry is laid onto a porous forming surface and formed into a sheet. Excess water is removed by a gravity drain and/or a suction drain. In addition, various presses can be used to facilitate water removal. The formed sheet can be dried and further treated.

Reconstituted substrates can also be made using various other different methods. For example, in one embodiment, the extracted cannabis and web building fibers may be extruded into a reconstituted material. In one embodiment, the reconstituted material can also be subjected to an expansion process. Expanded sheets can be made using, for instance, a gas, such as carbon dioxide, or by using a foaming agent. Suitable expansion mediums include starch, pullulan or other polysaccharides, solid foaming agents, inorganic salts and organic acids that provide in situ gaseous components, organic gaseous agents, inorganic gaseous agents, and volatile liquid foaming agents. Extruding also allows for the formation of rods or strands in addition to sheet materials.

In one aspect, the reconstituted plant material can be formed according to a cast leaf process. In a cast leaf process, the plant material is shredded and then blended with other materials, such as a binder, and formed into a slurry. Web building fibers can be contained within the slurry. To form a web of material, the slurry is transferred to a sheet forming apparatus. The sheet forming apparatus can be a continuous belt where the slurry may be continuously spread onto the belt. The slurry is distributed on the surface to form a sheet. The sheet is then dried, such as by using heat. The sheet can be wound onto a bobbin, trimmed, slitted or otherwise manipulated for forming products.

Optionally, the reconstituted plant material that is produced can also be treated with the cannabis soluble portion, such as a concentrated cannabis soluble portion that was separated from the insoluble fraction. The cannabis soluble portion can be applied to the web using various application methods, such as spraying, using a size press, saturating, etc. The amount of water soluble cannabis extracts applied to the reconstituted material can depend upon various factors and the anticipated end use application. In general, the water soluble cannabis extracts can be applied to the reconstituted plant material in an amount insufficient to adversely interfere with the taste of an aerosol produced by the underlying material. For instance, in one embodiment, the water soluble cannabis extracts are applied to the reconstituted material such that the reconstituted material contains water soluble cannabis extracts in an amount up to about 60% by weight, such as in an amount less than about 50% by weight, such as in an amount less than about 40% by weight, such as in an amount less than about 30% by weight, such as in an amount less than about 20% by weight, such as in an amount less than about 10% by weight, such as in an amount less than about 5% by weight, such as in an amount less than about 3% by weight and generally in an amount greater than about 0.5% by weight. In one embodiment, the water soluble cannabis extracts can be applied in an amount of from about 10% by weight to about 60% by weight, such as from about 15% by weight to about 40% by weight.

As described above, the reconstituted cannabis material of the present disclosure can be produced from various parts of the cannabis plant, including the hurds, leaves, buds, and flowers. These different parts of the plant can be combined in different ratios and amounts depending upon the particular application and the desired result. Although the reconstituted cannabis material can be made exclusively from cannabis leaves and hurds or can be made exclusively from cannabis buds and flowers, in one embodiment, the reconstituted material is made from a mixture of leaves and hurds combined with buds and/or flowers. For example, in one embodiment, the weight ratio between the leaves and hurds and the buds and/or flowers is from about 1:8 to about 8:1, such as from about 1:5 to about 5:1, such as from about 1:4 to about 4:1, such as from about 2:1 to about 1:2. In one embodiment, the ratio can be about 1:1.

In one embodiment, the reconstituted cannabis material may contain cannabis leaves and hurds in an amount greater than about 10% by weight, such as in an amount greater than about 20% by weight, such as in an amount greater than about 30% by weight, and generally in an amount less than about 70% by weight, such as in an amount less than about 60% by weight, such as in an amount less than about 50% by weight, such as in an amount less than about 40% by weight. Similarly, the reconstituted cannabis material may contain buds and/or flowers in an amount greater than about 10% by weight, such as in an amount greater than about 20% by weight, such as in an amount greater than about 30% by weight, such as in an amount greater than about 40% by weight, such as in an amount greater than about 50% by weight, such as in an amount greater than about 60% by weight, and generally in an amount less than about 80% by weight, such as in an amount less than about 70% by weight, such as in an amount less than about 60% by weight, such as in an amount less than about 50% by weight.

In addition to varying the amount of hurds, leaves, buds and flowers, the reconstituted cannabis material of the present disclosure can also be made exclusively from virgin plant materials, exclusively from cannabis extracted byproducts, or can be formed from a mixture of virgin plant materials and cannabis extracted byproducts. For instance, the cannabis extracted byproducts or biomass can make up greater than about 20% by weight, such as greater than about 40% by weight, such as greater than about 60% by weight, such as greater than about 80% by weight, such as greater than about 95% by weight of the cannabis plant portion of the reconstituted cannabis material. Likewise, the cannabis portion of the reconstituted cannabis material can comprise greater than about 20% by weight, such as greater than about 40% by weight, such as greater than about 60% by weight, such as greater than about 80% by weight, such as greater than about 90% by weight of virgin cannabis plant material.

The cannabis material can be combined with web building fibers. The web building fibers are incorporated into the reconstituted plant material or fiber substrate in an amount sufficient to provide strength and integrity to the resulting material. Web building fibers can also be incorporated into the reconstituted plant material so as to trap and prevent cannabis fibers and other cannabis components from separating from the fiber substrate. In general, any suitable web building fibers can be incorporated into the reconstituted plant material in order to improve one or more physical properties of the reconstituted material.

Various different types of web building fibers may be used. In one embodiment, the web building fibers are delignified cellulosic fibers. For instance, the web building fibers may comprise wood pulp fibers such as softwood fibers or hardwood fibers. Other cellulosic fibers that may be used include flax fibers, hemp fibers, abaca fibers, bamboo fibers, coconut fibers, cotton fibers, kapok fibers, 545 ramie fibers, jute fibers, or mixtures thereof. In one particular embodiment, the reconstituted plant material contains softwood fibers alone or in combination with other fibers such as hardwood fibers, abaca fibers, or the like. In one embodiment, the web building fibers can be hemp pulp fibers. In this manner, the reconstituted cannabis material can be made exclusively from cannabis plant parts. The hemp pulp fibers can have an average fiber length of generally greater than about 0.5 mm, such as greater than about 1 mm, such as greater than about 1.5 mm, such as greater than about 1.8 mm, and generally less than about 4 mm, such as less than about 3 mm, such as less than about 2.5 mm, such as less than about 2.35 mm.

In general, the web building fibers are present in the reconstituted plant material in an amount greater than about 3% by weight, such as in an amount greater than about 5% by weight, such as in an amount greater than about 8% by weight, such as in an amount greater than about 10% by weight, such as in an amount greater than about 15% by weight, such as in an amount greater than 20% by weight. The web building fibers are generally present in the reconstituted plant material in an amount less than about 50% by weight, such as in an amount less than about 30% by weight, such as in an amount less than about 20% by weight, such as in an amount less than about 15% by weight.

In one embodiment, the web building fibers incorporated into the reconstituted plant material include a combination of longer fibers and shorter fibers. The longer fibers can generally have an average length of greater than about 1.8 mm, such as greater than about 2 mm, while the shorter fibers can generally have an average length of less than about 1.5 mm. The longer fibers can be used to improve strength and integrity, while the shorter fibers can better retain the cannabis fibers and other components within the fiber substrate. In one embodiment, for instance, the short fibers may be present in the reconstituted plant material in an amount greater than about 3% by weight, such as in an amount greater than about 5% by weight, and generally in an amount less than about 20% by weight. The longer fibers, on the other hand, can be present in the reconstituted web material in an amount greater than about 2% by weight, such as in an amount greater than about 5% by weight, and generally in an amount less than about 30% by weight, such as in an amount less than about 15% by weight. In one embodiment, the shorter fibers comprise hardwood fibers, while the longer fibers comprise softwood fibers.

In addition to extracted cannabis fibers and web building fibers, the reconstituted cannabis material of the present disclosure can also contain various other plant fibers. In one embodiment, for instance, the reconstituted cannabis material can contain extracted cocoa husk fibers. Extracted cocoa husk fibers, for instance, have been found to produce an aerosol very neutral in taste. Adding cocoa husk fibers to the reconstituted cannabis material can further improve the taste of the overall product.

Cocoa materials for use in the present disclosure are obtained from *Theobroma cacao*, which is also referred to as the cacao tree. The cacao tree is in the evergreen family and is native to tropical regions. The cacao tree produces a fruit, referred to as a cacao pod. Cacao pods are generally yellow to orange in color and can weigh over one pound when ripe. The pod contains anywhere from 10 to about 80 cocoa beans that are used to produce chocolate, juices, jelly, and the like. After the beans are removed from the cacao pod, the cocoa beans are dried and cured or fermented by being exposed to sunlight and/or ultraviolet light. Each individual bean is covered in a husk or shell. The husk or shell is removed from the bean prior to using the bean for producing food products. The reconstituted plant material of the present disclosure can contain the cocoa shells or husks, although other components of the cacao pod may also be used.

The cocoa shell or husk contains fibers which are well suited to producing substrates and web materials. In one embodiment, the cocoa husks are optionally sized or ground and then subjected to an extraction process for removing water soluble components. The extraction process can occur separate from the cannabis materials or the cocoa husk materials can be combined with the raw cannabis materials and subjected to the same extraction process together.

The amount of extracted cocoa husk fibers contained in the reconstituted plant material can depend upon the particular application and the desired result. Extracted cocoa husk fibers, for instance, can be present in the reconstituted plant material in an amount anywhere from 1% by weight to about 80% by weight, such as from about 5% by weight to about 50% by weight. For example, the extracted cocoa husk fibers can be present in the reconstituted plant material in an amount greater than about 10% by weight, such as in an amount greater than about 20% by weight, such as in an amount greater than about 30% by weight, and generally in an amount less than about 60% by weight, such as in an amount less than about 50% by weight, such as in an amount less than about 40% by weight.

In one embodiment, the reconstituted web material can further contain a humectant. The humectant can be incorporated into the reconstituted plant material for various different reasons in order to provide different benefits and advantages. For instance, in one embodiment, a humectant may be incorporated into the reconstituted plant material in order to improve the processability and handling of the resulting fiber substrate. In an alternative embodiment, a humectant can be added to the reconstituted plant material in greater amounts so that the material is well suited for use in applications where the material is heated but not burned in order to produce an inhalable aerosol.

Various different humectants can be incorporated into the reconstituted plant material. The humectant, for instance, may comprise glycerol, propylene glycol, or mixtures thereof. Other humectants that may be used include sorbitol, triethylene glycol, lactic acid, glyceryl diacetate, glyceryl triacetate, triethyl citrate, isopropyl myristate, and mixtures thereof including mixtures with glycerol and/or propylene glycol.

As described above, the amount of humectant applied to the reconstituted plant material can depend upon various factors. In one embodiment, for instance, the humectant is present on the reconstituted plant material in an amount less than about 5% by weight, such as in an amount less than about 3% by weight, and generally in an amount greater than about 0.5% by weight, such as greater than about 1% by weight. In other embodiments, the humectant may be present on the plant material in an amount greater than about 5% by weight, such as in an amount greater than about 10% by weight, such as in an amount greater than about 15% by weight, such as in an amount greater than about 20% by weight, and generally in an amount less than about 50% by weight, such as in an amount less than about 40% by weight, such as in an amount less than about 30% by weight, such as in an amount less than about 25% by weight. When added to the reconstituted plant material in an amount from about 10 to 40% by weight, such as in an amount from about 12 to about 30% by weight, such as in an amount from about 15 to about 25% by weight, the humectant serves as an aerosol generating agent that facilitates formation of an aerosol when the reconstituted plant material is heated without being combusted.

The reconstituted plant material of the present disclosure can also contain various other optional components. For example, in one embodiment, the reconstituted plant material can optionally be treated with a burn control agent. The burn control agent can control the burn rate of the material and/or can serve as an ash conditioner for improving the coherency and/or color of the ash that is produced when the material is combusted.

The burn control agent, for instance, may comprise a salt of a carboxylic acid. For example, the burn control agent may comprise an alkali metal salt of a carboxylic acid, an alkaline earth metal salt of a carboxylic acid, or mixtures thereof. Examples of burn control agents that may be used include a salt of acetic acid, citric acid, malic acid, lactic acid, tartaric acid, carbonic acid, formic acid, propionic acid, glycolic acid, fumaric acid, oxalic acid, malonic acid, succinic acid, nitric acid, phosphoric acid, or mixtures thereof. Particular burn controlling agents that may be used include potassium citrate, sodium citrate, potassium succinate, sodium succinate, or mixtures thereof. When present, the burn control agent can be applied to the reconstituted plant material generally in an amount greater than about 0.1% by weight, such as in an amount greater than about 0.5% by weight, such as in an amount greater than about 1% by weight and generally less than about 5% by weight, such as less than about 4% by weight, such as less than about 3% by weight, such as less than about 2% by weight.

The above burn control agents, depending upon the amount applied to the reconstituted plant material, may accelerate the burn rate of the material. The reconstituted cannabis material of the present disclosure, however, has been found to have exceptionally good burn properties without the need to add a burn control agent. In fact, in one embodiment, a burn retardant may optionally be applied to the reconstituted plant material. The burn retardant, for instance, may comprise a film-forming polymer, such as an alginate, guar gum, pectin, polyvinyl alcohol, a cellulose derivative, a starch, a starch derivative, or the like. Other burn retardants include aluminum ammonium sulfate, diammonium hydrogen orthophosphate, ammonium dihydrogen orthophosphate, sodium dihydrogen orthophosphate, boric acid, aluminum borate, calcium borate, ammonium bromide, lithium bromide, magnesium bromide, ammonium chloride, magnesium chloride, zinc chloride, aluminum phosphate, calcium phosphate, potassium silicate, aluminum sulfate, calcium sulfate, magnesium sulfate, sodium carbonate, and mixtures thereof. When present, the burn retardant can be applied to the reconstituted plant material in an amount greater than about 0.1% by weight, such as in an amount greater than about 0.3% by weight, and generally in an amount less than about 2% by weight, such as in an amount less than about 1% by weight.

The reconstituted plant material of the present disclosure may also optionally contain a filler. The filler can comprise particles incorporated into the reconstituted web material for any desired purpose, such as for facilitating formation of the reconstituted plant material and/or for affecting the appearance of the material. Filler particles that may be incorporated into the reconstituted web material can be made from calcium carbonate, magnesium oxide, titanium dioxide, kaolin clay, barium sulfate, a silicate, bentonite, mica, or mixtures thereof. Filler particles can optionally be incorporated into the reconstituted web material in an amount greater than about 1% by weight, such as in an amount greater than about 5% by weight, such as in an amount greater than about 10% by weight, and generally in an amount less than about 30% by weight, such as in an amount less than about 25% by weight, such as in an amount less than about 20% by weight, such as in an amount less than about 15% by weight.

Once the reconstituted plant material has been formed into a fibrous substrate as described above, the material can be used as an aerosol generating material for use in any suitable smoking article or in a device that heats but does not combust the material. In one embodiment, the reconstituted plant material can first be formed into a loose filler material by being fed through a shredding or cutting process. For instance, the loose filler material can be in the forms of a strip, strips, shreds, or mixtures thereof. The loose filler material can then be packed into any suitable aerosol generating device or smoking article.

The reconstituted plant material of the present disclosure produces an aerosol or smoke that has a characteristic cannabis taste and smell without containing harsh components or irritants.

The reconstituted plant material may be used alone to produce an aerosol generating material or can be combined with other aerosol generating filler materials. In one embodiment, for instance, the reconstituted plant material of the present disclosure can be combined with a tobacco material. The tobacco material blended with the reconstituted plant material of the present disclosure can comprise, for instance, cut leaf tobacco, a reconstituted tobacco material, or mixtures thereof. In one embodiment, the reconstituted plant material of the present disclosure can be in the form of a loose filler material that is homogenously blended with a tobacco material. The aerosol generating material, for instance, may contain the reconstituted plant material of the present disclosure in an amount greater than about 5% by weight, such as in an amount greater than about 10% by weight, such as in an amount greater than about 20% by weight, such as in an amount greater than about 30% by weight, such as in an amount greater than about 40% by weight, such as in an amount greater than about 50% by weight, such as in an amount greater than about 60% by weight, such as in an amount greater than about 70% by weight, such as in an amount greater than about 80% by weight. The reconstituted plant material of the present disclosure can be combined with a tobacco material such that the resulting aerosol generating material may contain the reconstituted plant material in an amount less than about 90% by weight, such as in an amount less than about 80% by weight, such as in an amount less than about 70% by weight, such as in an amount less than about 60% by weight, such as in an amount less than about 50% by weight, such as in an amount less than about 40% by weight, such as in an amount less than about 30% by weight. For example, in one embodiment, the aerosol generating material may contain the reconstituted plant material of the present disclosure in an amount from about 5% to about 30% by weight, such as in an amount from about 10% to about 20% by weight. In an alternative embodiment, greater amounts of the reconstituted plant material may be incorporated into the aerosol generating material. In this embodiment, the reconstituted plant material may be contained in the aerosol generating material in an amount from about 30% to about 80% by weight, such as in an amount from about 40% to about 60% by weight. The above weight percentages are based upon the total weight of the aerosol generating material. The remaining portion of the aerosol generating material can be supplied exclusively by a tobacco filler.

In an alternative embodiment, the reconstituted plant material of the present disclosure may be combined with other cannabis filler materials. For example, the reconstituted material of the present disclosure can be in the form of a loose filler that is homogeneously blended with other cannabis filler materials. The other cannabis filler materials may include, for instance, dried flowers, dried buds, seeds, dried leaves, dried stems, mixtures thereof, and the like. The other cannabis materials, for instance, may comprise materials that have not been subjected to an extraction process. The resulting aerosol generating material can contain the reconstituted cannabis material of the present disclosure generally in an amount greater than about 20% by weight, such as in an amount greater than about 30% by weight, such as in an amount greater than about 40% by weight, such as in an amount greater than about 50% by weight, such as in an amount greater than about 60% by weight, and generally in an amount less than about 90% by weight, such as in an amount less than about 80% by weight, such as in an amount less than about 70% by weight, such as in an amount less than about 60% by weight, such as in an amount less than about 50% by weight, such as in an amount less than about 40% by weight. The remainder of the aerosol generating material can then be made up of the cannabis material combined with the reconstituted material.

In addition to or instead of being combined with a tobacco material, the reconstituted cannabis material of the present disclosure can also be combined with various herbal fillers. The reconstituted cannabis material, for instance, can be homogeneously blended with various different types of herbal fillers. The weight ratio between the reconstituted cannabis material and the herbal filler can generally be from about 1:8 to about 8:1, such as from about 1:5 to about 5:1, such as from about 2:1 to about 1:2.

For instance, the reconstituted plant material of the present disclosure can also be combined with aerosol generating fillers made from herbal plant materials, such as botanical plants, and trees, such as cocoa tree, coffee tree or coffee bean, tea tree or tea leaf, vine, ginger, ginkgo, camomile, tomato, ivy, maté, rooibos, cucumber, mint, a cereal such as wheat, barley or rye, or other trees such as broadleaved or resinous trees, and the like, as well as combinations thereof.

The reconstituted cannabis material of the present disclosure is also well suited for receiving various different topical additives. In this regard, the reconstituted cannabis material can serve as a carrier for delivering various active agents in the aerosol generated by the material. The reconstituted plant material, for instance, is highly absorbable and can contain up to 50% by weight of topical additives.

In this regard, the reconstituted cannabis material of the present disclosure can be treated with various different aerosol delivery compositions that can contain one or more aerosol delivery agents. Aerosol delivery compositions that can applied to the reconstituted plant material of the present disclosure include solutions, suspensions, oils, and the like. Solutions and suspensions, for instance, can be applied to the reconstituted plant material and later dried leaving behind a solid residue within the fiber substrate.

In one embodiment, an aerosol delivery composition may be obtained by extracting a plant substance from a plant for application to the reconstituted plant material. Additionally or alternatively, the present disclosure may include a step for isolating at least one compound from a plant substance, concentrating a plant substance, or even a purifying or eliminating a compound from a plant substance, in order to obtain a modified plant substance to be applied to the reconstituted material. While optional, such a process may result in the transformation of an original raw plant substance into a modified plant substance, whether in the form of dry extracts, liquid extract, a liquor or an isolated substance, based upon the desired end properties of the plant substance to be applied to the reconstituted material. Of course, while the plant substance may be an original plant substance or a modified plant substance, in one embodiment, the plant substance is applied to the reconstituted plant material without undergoing any further processing after extraction. Furthermore, while the aerosol delivery composition has been described as being extracted from a plant, it should be understood that synthetic or naturally occurring aerosol delivery compositions (e.g. without needing to be extracted) may also be used.

Examples of aerosol delivery agents that may be contained in the aerosol delivery composition include, or may be an extract of, (in addition to nicotine) sugars, licorice extracts, menthol, honey, coffee, maple syrup, tobacco, botanical extracts, plant extracts, tea, fruit extracts, flavorings such as clove, anise, cinnamon, sandalwood, geranium, rose oil, vanilla, caramel, cocoa, lemon oil, cassia, spearmint, fennel, or ginger, fragrances or aromas such as cocoa, vanilla, and caramel, medicinal plants, vegetables, spices, roots, berries, bar, seeks, essential oils and extracts thereof, such as anise oil, clove oil, carvone and the like, artificial flavoring and fragrance materials such as vanillin, and mixtures thereof. The extracts applied to the reconstituted plant material can be water soluble or oil soluble. Thus, various different carrier liquids can be used to apply the aerosol delivery agents to the reconstituted plant material.

In one embodiment, the reconstituted plant material of the present disclosure can be used as a carrier for cannabis components, such as cannabinoids. Cannabis, for instance, contains various cannabinoids that can be used for pain relief. Applying cannabinoids topically to the reconstituted plant material allows for uniform and consistent deliveries of the cannabinoids when contained in an aerosol generated by the reconstituted plant material and inhaled. Consequently, in one embodiment, the reconstituted cannabis material of the present disclosure can be made from plant material that does not contain or contains very low amounts of cannabinoids. Cannabinoids can then be extracted from cannabis plants and then applied to the reconstituted plant material of the present disclosure. In this manner, cannabinoid levels in the aerosol generating material can be carefully controlled. An aerosol produced from the material can also deliver the cannabinoids in a consistent manner that does not vary from puff to puff.

Cannabinoids that can be incorporated into the reconstituted plant material of the present disclosure include cannabidiol (CBD) and tetrahydrocannabinol (THC). THC contained in cannabis acts on specific receptors in the brain which lead to a feeling of euphoria and a relaxed state. CBD, on the other hand, also interacts with pain receptors in the brain but does not create the same euphoric feeling caused by THC. In accordance with the present disclosure, in one embodiment, THC can be applied to the reconstituted plant material of the present disclosure, CBD can be applied to the reconstituted plant material or, alternatively, both THC and CBD can be applied to the reconstituted plant material.

In addition to THC and CBD, various other cannabinoids can also be incorporated into an aerosol delivery composition and applied to the reconstituted plant material in accordance with the present disclosure. For instance, other cannabinoids contained in cannabis include cannabichromene, cannabinol, cannabigerol, tetrahydrocannabivarin, cannabidivarin, cannabidiolic acid, other cannabidiol derivatives, and other tetrahydrocannabinol derivatives. The above cannabinoids can be used singularly or in any combination and applied to the reconstituted plant material.

The cannabinoids described above can be applied to the reconstituted plant material using various different methods. For instance, in one embodiment, the cannabinoid, such as CBD, can be formulated into a powder that can be applied to the reconstituted plant material as an aqueous suspension. Alternatively, a cannabis oil extract may be obtained from raw cannabis plants. The oil extract may contain THC alone, CBD alone, or a combination of THC and CBD. The oil extract can be applied to the reconstituted plant material so that an aerosol generated by the material contains controlled amounts of the cannabinoids.

Another component that can be added to the reconstituted cannabis material are various flavorants, especially terpenes. A terpene or a blend of terpenes, for instance, can be used to develop desirable aromas and indicate to the user the quality of the product. One or more terpenes can also improve the sensory reaction to inhaling an aerosol created by the reconstituted material.

Various different terpenes can be applied to the reconstituted plant material. Such terpenes include but are not limited to pinene, humulene, b-caryophyllene, isopulegol, guaiol, nerylacetate, neomenthylacetate, limonene, menthone, dihydrojasmone, terpinolene, menthol, phellandrene, terpinene, geranylacetate, ocimene, myrcene, 1,4-cineole, 3-carene, linalool, menthofuran, perillyalcohol, pinane, neomenthylaceta, alpha-bisabolol, borneol, camphene, camphor, caryophyllene oxide, alpha-cedrene, beta-eudesmol, fenchol, geraniol, isoborneol, nerol, sabinene, alpha-terpineol, and mixtures thereof.

In one embodiment, various different terpenes can be blended together in order to mimic the ratios of terpenes found in natural cannabis plants. For instance, from about 2 to about 12 terpenes can be blended together and applied to the reconstituted plant material. Each terpene can be applied to the reconstituted plant material in an amount greater than about 0.001% by weight and generally less than about 2% by weight. For instance, each terpene can be applied in an amount from about 0.01% by weight to about 1.5% by weight. For instance, each terpene can be applied in an amount from about 0.1% to about 1.1% by weight.

Exemplary blends of terpenes include alpha-pinene, beta-caryophyllene, and beta-pinene; alpha-humulene, alpha-pinene, beta-caryophyllene, beta-pinene, and guaiol; beta-caryophyllene, beta-pinene, and d-limonene; beta-caryophyllene, beta-pinene, and nerolidol; beta-caryophyllene, beta-pinene, d-limonene, and terpinolene; alpha-bisabolol, alpha-pinene, beta-caryophyllene, beta-myrcene, beta-pinena, and d-limonene; beta-caryophyllene, beta-pinena, and p-cymene; alpha-humulene, beta-caryophyllene, beta-pinene, d-limonene, linalool, and nerolidol; beta-caryophyllene and beta-pinene; beta-caryophyllene, beta-myrcene, and terpinolene; and alpha-pinene, beta-caryophyllene, beta-pinene, d-limonene; alpha-humulene, alpha-pinene, beta-caryophyllene, beta-myrcene, beta-pinena, d-limonene, and guaiol.

Aerosol delivery compositions containing one or more aerosol delivery agents as described above can be applied to the reconstituted plant material using any suitable method or technique. For instance, the aerosol delivery composition can be sprayed or coated onto the fiber substrate in any suitable manner.

Reconstituted plant materials made in accordance with the present disclosure have excellent mechanical characteristics and have a very desirable and aesthetic appearance. In general, the reconstituted plant material has a basis weight of greater than about 40 gsm, such as greater than about 45 gsm, such as greater than about 55 gsm. The basis weight of the reconstituted plant material is generally less than about 120 gsm, such as less than about 100 gsm, such as less than about 85 gsm.

In one embodiment, the reconstituted plant material of the present disclosure can be formed into a loose filler using various methods, such as extrusion or through cutting and/or shredding the reconstituted material. Filler material made in accordance with the present disclosure can have a filling power of greater than about 4 $cm^3/g$, such as greater than about 5 $cm^3/g$, such as greater than about 6 $cm^3/g$, and generally less than about 10 $cm^3/g$, such as less than 910 about 8 $cm^3/g$. The reconstituted plant material can have excellent burn properties. For instance, the reconstituted plant material can have a static burn rate of greater than about 4 mm/mm, such as greater than about 5 mm/mm, and generally less than about 8 mm/mm, such as less than about 7 mm/mm.

The aerosol generating material incorporating the reconstituted plant material of the present disclosure can be used in all different types of aerosol generating products. In one embodiment, for instance, the aerosol generating material of the present disclosure can be formed into a smokable rod and surrounded by an outer wrapper. The smoking article, or cigarette, can include a filter located at one end of the smoking article.

In one embodiment, the reconstituted plant material is formed on a paper forming machine and is in the form of a sheet. The sheet can then be cut into strips and fed to a rotating or agitated drum. When in the drum, the reconstituted plant material can be mixed with one or more humectants and a casing. The casing can contain various different flavorants or mainstream smoke enhancing elements. For instance, the casing may contain licorice, corn syrup, and/or sugar. From the drum, the reconstituted plant material can undergo a cutting or grinding process in order to reduce the material to a desired particle size. The cut reconstituted plant material is sometimes referred to as cut rag. Once cut to a desired size, various different aerosol delivery agents or flavorants can be applied to the reconstituted plant material. For instance, one or more terpenes can be applied to the reconstituted plant material and/or one or more cannabinoids, such as CBD and/or THC. Once the aerosol delivery agents are applied to the reconstituted plant material, the reconstituted plant material can be packaged and shipped for use in any suitable form. In one aspect, the reconstituted plant material can be fed to a cigarette making machine for forming the reconstituted plant material into rod-like elements. Alternatively, the material can be packaged in loose form and used as a filling for roll-your-own products, heat but not burn products, or smokeless blend products.

In addition to cigarettes, aerosol generating materials made according to the present disclosure can also include cigars and cigarillos.

As described above, the reconstituted plant material of the present disclosure can also be used to produce a smokeless blend product. The smokeless product can be a dry product or can contain substantial amounts of moisture.

When producing a smokeless blend product, the product can be made exclusively from the reconstituted plant material of the present disclosure or can be formed from the reconstituted plant material of the present disclosure blended with other filler materials. When the reconstituted plant material of the present disclosure is used to form a smokeless blend, the amount of web building fibers contained in the product may be reduced. For instance, the amount of web 950 building fibers can be less than about 5% by weight, such as less than about 3% by weight. In one aspect, the reconstituted plant material may not contain any web building fibers. In other embodiments, the web building fibers may be present in an amount from about 5% to about 40% by weight.

In order to form a smokeless blend product, the reconstituted plant material of the present disclosure is ground or cut to a desired size. For instance, the particle size can be relatively small or can be made into strips depending upon the end use application. In one aspect, for instance, the material is cut or ground so as to have an average particle size of greater than about 50 microns, such as greater than about 100 microns, and generally less than about 3 mm, such as less than about 2 mm. Alternatively, the material can be ground into a powder or a granular material wherein the average particle size is less than about 100 microns.

If desired, the reconstituted plant material can be subjected to a heat treatment. The heat treatment may provide the material with texture and color and enhance the natural flavors. After an optional heat treatment step, additives such as pH-regulators and flavorings can be added to the mixture. When forming a moist smokeless product, water can be added to the product such that the water content is greater than about 10% by weight, such as greater than about 20% by weight, such as greater than about 30% by weight, such as greater than about 40% by weight, and generally less than about 60% by weight, such as less than about 50% by weight. If desired, one or more moisture agents can be added to the product that facilitates the moisture retaining properties of the blend. In one aspect, for instance, sodium chloride and/or sodium carbonate can be added to the reconstituted plant material Alternatively, the reconstituted plant material can be used to produce a dry snuff, such as a dry oral snuff. In order to produce a dry oral snuff, the material is ground into a powder to which other ingredients such as flavors are added.

In one aspect, the smokeless reconstituted cannabis material can be placed in an oral pouch that is intended for use in the oral cavity, such as by placing the pouch between the upper and lower gum of the lip or cheek. The oral pouched product may have an oblong shape, such as a rectangular shape. The total weight of the oral pouch can generally be in the range of from about 0.1 g to about 2.5 g, such as from about 0.2 g to about 0.8 g. The pouch can be made of any suitable saliva-permeable pouch material, such as a nonwoven. A binder may be included in the pouch to facilitate sealing of the material by ultrasonic welding. The binder, for instance, can be an acrylate polymer. In one aspect, the pouch can be formed from a nonwoven material containing regenerated cellulose fibers, such as viscose rayon staple fibers and a binder. If desired, the pouch material may also contain additional flavoring agents and/or colorants.

In one embodiment, smoking articles made according to the present disclosure can also have reduced ignition propensity characteristics. For instance, an outer wrapper of the smoking article can include a plurality of discrete reduced ignition areas spaced in the axial direction of the smoking article. For instance, in one embodiment, the discrete reduced ignition areas may be in the form of circular bands. The bands can have a width so that oxygen is limited to the burning coal for a sufficient length or period of time to extinguish the coal if the smoking article were left in a static burn condition. The bands, for instance, can have a width of generally greater than about 3 mm, such as greater than about 4 mm, such as greater than about 5 mm, and generally less than about 10 mm, such as less than about 8 mm, such as less than about 7 mm.

The spacing between the reduced ignition areas can also vary depending upon a number of variables. The spacing should not be so great that the cigarette burns for a sufficient length of time to ignite a substrate before the coal burns into a reduced ignition area. The spacing also affects the thermal inertia of the burning coal, or the ability of the coal to burn through the reduced ignition areas without self-extinguishing. In general, the band spacing should be greater than about 5 mm, such as greater than about 10 mm, such as greater than about 15 mm, and generally less than about 50 mm, such as less than about 40 mm, such as less than about 30 mm. Each smoking article can contain from about 1 to about 3 bands.

In general, any suitable ignition reducing composition can be applied to the outer wrapper of the smoking article. In one embodiment, for instance, the ignition reducing composition contains a film-forming material. For example, film-forming materials that can be used in accordance with the present invention include alginates, guar gum, pectin, polyvinyl alcohol, polyvinyl acetate, cellulose derivatives such as ethyl cellulose, methyl cellulose, and carboxymethyl cellulose, starch, starch derivatives, and the like.

In one particular embodiment, the film-forming material may comprise an alginate, alone or in combination with starch. In general, an alginate is a derivative of an acidic polysaccaride or gum which occurs as the insoluble mixed calcium, sodium, potassium and magnesium salt in the Phaeophyceae brown seaweeds. Generally speaking, these derivatives are calcium, sodium, potassium, and/or magnesium salts of high molecular weight polysaccarides composed of varying proportions of D-mannuronic acid and L-guluronic acid. Exemplary salts or derivatives of alginic acid include ammonium alginate, potassium alginate, sodium alginate, propylene glycol alginate, and/or mixtures thereof.

In one embodiment, a relatively low molecular weight alginate may be used. For example, the alginates may have a viscosity of less than about 500 cP when contained in a 3% by weight aqueous solution at 25° C. More particularly, the alginates may have a viscosity of less than 250 cP at the above conditions, particularly less than 100 cP, and in one embodiment at a viscosity of about 20-60 cP. As used herein, viscosity is determined by a Brookfield LVF Viscometer with a suitable spindle according to the viscosity. At the above lower viscosity levels, alginate compositions can be formed at a higher solids content, but yet at a low enough solution viscosity to permit the application of the composition to a paper wrapper using conventional techniques. For example, the solids content of an alginate solution made in accordance with the present invention can be greater than about 6%, particularly greater than about 10%, and more particularly from about 10% to about 20% by weight.

At the above solids levels, alginate compositions used in accordance with the present invention can have a solution viscosity of greater than about 250 cP, particularly greater than about 500 cP, more particularly greater than about 800 cP, and in one embodiment at a viscosity of greater than about 1,000 cP at 25° C. In general, the solution viscosity of the alginate film-forming composition can be adjusted depending upon the manner in which the composition is being applied to the wrapper. For instance, the solution viscosity of the composition can be adjusted depending upon whether or not the composition is being sprayed onto the wrapper or printed onto the wrapper.

In other embodiments, it should also be understood that depending upon the application a relatively high molecular weight alginate may be used. For example, the alginate may have a viscosity of greater than about 500 cP when contained in a 3% by weight aqueous solution at 25° C.

In addition to the film-forming material, the reduced ignition composition applied to the wrapper can contain various other ingredients. For instance, in one embodiment, a filler can be contained within the composition. The filler can be, for instance, calcium carbonate, calcium chloride, calcium lactate, calcium gluconate, and the like. In addition to calcium compounds, other various particles may be used including magnesium compounds such as magnesium oxide, clay particles, and the like.

The ignition reducing composition, in one embodiment, can be water based. In particular, the ignition reducing composition may comprise an aqueous dispersion or aqueous solution. Alternatively, the ignition reducing composition prior to being applied to the wrapper may comprise a non-aqueous solution or dispersion. In this embodiment, for instance, an alcohol may be present for applying the composition to the wrapper.

As opposed to a film-forming composition, the ignition reducing composition may also comprise a cellulose slurry (a type of dispersion). As used herein, a slurry containing papermaking materials is not a film-forming composition. The cellulose slurry applied to the paper substrate may comprise fibrous cellulose, one or more fillers, and/or cellulose particles. As used herein, cellulose fibers and cellulose particles are to be differentiated from derivatized cellulose such as carboxymethyl cellulose. Cellulose fibers and cellulose particles, for instance, are not water soluble. In one embodiment, the cellulose slurry applied to the wrapper may comprise microcrystalline cellulose.

Once the ignition reducing composition is formulated, the composition can be applied to a wrapper in discrete areas. The manner in which the composition is applied to the wrapper can vary. For example, the composition can be sprayed, brushed, applied with a moving orifice, or printed onto the wrapper. To form a treated area, the composition can be applied in a single pass or in a multiple pass operation. For instance, the composition can be applied to the wrapper in successive steps in order to form areas on the wrapper having reduced ignition proclivity. In general, during a multiple pass process, the treated areas can be formed by applying the composition during from about 2 to about 8 passes.

The amount of reduced ignition composition applied to the wrapper can also vary. For instance, the composition can be applied to the wrapper in an amount less than about 15% by weight, such as less than about 10% by weight, such as less than about 8% by weight. In general, the composition is applied in an amount greater than 1% by weight based upon the weight of the composition within the reduced ignition areas.

As used herein, the above weight percentages are based on the area treated with the chemical components. In other words, the weight percentages above for the reduced ignition composition is the amount applied within the treated areas as opposed to the total amount applied over the entire surface of the wrapper.

Through the process of the present disclosure, reduced ignition areas can be produced having a relatively high permeability while also having a relatively low diffusivity. For instance, the reduced ignition areas can have a permeability greater than 10 CORESTA while still being capable of producing smoking articles that pass ASTM Test E2187-09 at least 75% of the time.

In general, the reduced ignition areas have a diffusivity that is relatively low. The diffusivity can be measured at room temperature (23° C.). In general, the diffusivity at 23°C of the reduced ignition areas is less than about 0.5 cm/s, such as less than 0.4 cm/s, such as less than 0.3 cm/s. In one embodiment, the reduced ignition areas may have a diffusivity of greater than about 0.05 cm/s, such as greater than about 0.15 cm/s, such as greater than 0.16 cm/s, such as greater than 0.17 cm/s, while still having the desired reduced ignition proclivity characteristics. Diffusivity is measured using a Sodim $CO_2$ diffusivity tester.

In addition to being incorporated into smoking articles, the aerosol generating material of the present disclosure can also be packaged and sold in various other forms to consumers. For instance, in one embodiment, the aerosol generating material can be packaged and sold as a filler material in the form of strips or shreds. The filler material can then be used in pipes, as a filler in a roll-your-own smoking article, or can be used in an aerosol generating device that heats but does not combust the material.

The present disclosure may be better understood with reference to the following examples.

EXAMPLES

The following test methods are used to not only define the various parameters but also were used in obtaining the results in the examples below.

Tests & Methods

Filling power and Equilibrium Moisture Content (EMC)

The sample of filler material is conditioned according to ISO 3402 (22° C.+/−1° C., 60%+/−3% R.H., during min. 48 hrs). After conditioning, the material is unfolded and cut into cut rag (equipment: BUROMA disc cutter; width: 0.7 mm).

To perform filling power analysis, 14 g of cut filler (precision: +/−0.01 g) is placed into a Borgwaldt cylinder (DM4625 model; diameter=5.98 cm, height=10.8 cm). A weight of 2 kg is applied during 60 sec. When the piston is released, the height of the filler column is displayed and recorded (H, in cm).

The filling power of the sample (in co/g) is calculated as: 2×H.

Equilibrium Moisture Content is measured according to the following method: The weight of an empty pan (made of glass) is measured, at a precision of +/−1 mg, and recorded (T).

The pan is then filled with cut filler (between 5 and 7 g) and the weight of the pan with cut filler is recorded (W1, precision +/−1 mg).

The pan with cut filler is then dried in a Hearson oven (Mark V), during 3 hrs (+/−5 min), at 100° C.

After drying, the pan is cooled in a dessicator during 15 min and its weight is measured (W2, precision +/−1 mg).

$$\frac{W1 - W2}{W1 - T} \times 100$$

Moisture of the sample (%) is calculated as:

Water Solubles Content

The sample of filler is ground into powder (using a IKA or RETSCHE-MUHLE grinder; mesh size: 1 mm).

A glass fiber filter (DURIEUX filter Nr 28, diam.=55 mm) is placed in a stainless steel pan. The tare of the pan+filter is then weighed (T, precision +/−1 mg). A 5000 mg (+/−200 mg) sample of ground filler is placed in the pan and precisely weighed (W1, precision +/−1 mg).

The ground filler is gently sprayed with water and the cup is installed into a lab percolator (RENEKA LC). Extraction is performed three times according to the pre-defined percolation settings. After percolation, the sample is cautiously washed with water and the pan is dried in an electric oven for 16 hrs at 100° C.

After washing, the pan is cooled in a dessicator during 15 min and its weight is measured (W3, precision +/−1 mg).

Dry weight of the ground sample used for Water solubles test (W2) is calculated as: W2=W1×(100−H)/100.

Finally, the ratio of Water solubles (%) in the dry finished product is calculated as follows:

$$WS\ (\%) = 1.15 \times \left(\left(\frac{W2 - (W3 - T)}{W2}\right) \times 100\right) - 2.0$$

Cigarettes Making

The sample of filler is conditioned according to ISO 3402 (22° C.+/−1° C., 60%+/−3% R.H., during min. 48 hrs). After conditioning, the filler sheets are cut into shreds (equipment: BUROMA disc cutter; width: 0.7 mm). The cut material is sieved on a laboratory sieve (mesh size: 1 mm).

Empty cigarettes tubes are then filled with 100% cut filler, using a hand rolling machine from PRIVILEG. The weight of cut filler is adjusted to reach a Pressure Drop of 100+/−5 mm WG.

The empty tubes have the following characteristics:

tube weight=200±5 mg, total length=84 mm, diameter=8.1±0.1 mm, tipping length=25 mm acetate filter (denier=3.0 Y/35000 HK, length=15±0.5 mm, pressure drop=43±3 mm WG), cigarette paper porosity=50 CU, no filter ventilation.

Cigarettes are then sorted on a SODIMAT machine. The lot of cigarettes selected to perform smoke analyses have the following characteristics: filler weight: average target weight +/−10 mg, pressure drop: average target PD+/−3.5 mm WG.

Before performing smoke analyses, cigarettes are conditioned according to ISO 3402 (22° C.+/−1° C., 60%+/−3% R.H., during min. 48 hrs).

Analysis of Combustibility 10 cigarettes are positioned on a FILTRONA static burn rate machine. This machine has 10 cigarette holders and 10 individual chronometers.

Two cotton threads, 40 mm away from each other, are settled right over the 10 cigarettes. Each thread is connected to the chronometer.

The cigarettes are lit sequentially. For each cigarette, when the combustion cone cuts the front cotton line, the chronometer is automatically activated. Once the char line reaches the second cotton thread, the chronometer automatically stops thus giving the time necessary to burn 40 mm of the filler rod.

An average time (in seconds) is calculated from the 10 chronometers.

The average combustibility (in mm/min) is calculated as:

$$\frac{40 \times 60}{\text{Average time}}$$

Analysis of Tar, Nicotine, Water and CO in Smoke 2 sets of 20 cigarettes are smoked on a Borgwaldt RM20 kit machine, in standard ISO conditions (ISO 3308).

Nicotine and water in smoke (mg/cig) are measured by Gas Chromatography, according to standards ISO 10315 and ISO 10362-1.

Tar in smoke (mg/cig) is measured according to standard ISO 4387.

CO in smoke (mg/cig) is measured by Non-Dispersive Infra-Red (NDIR) method, according to standard ISO 8454.

Example 1

A hemp filler according to the present disclosure comprising fibres originating from hemp (*Cannabis* spp) plant was manufactured according to the following method: hemp leaves and hemp flowers in a ratio of 50%/50% were ground using a knife mill so as to obtain particles about 1 mm in size. The ground hemp material was then mixed with water at 70° C. for 45 minutes, in a hemp/water ratio of 1/10. The mixture was then pressed so as to separate the aqueous part (hemp fluid) from the insoluble part (hemp fibres). The fibrous fraction was refined using disc refiners. After refining, delignified fibres originating from resinous trees (softwood fibers) were added to the refined fibre fraction in a ratio of delignified fibres/fibres from hemp plant of 15%/85% so as to manufacture hemp filler sheets. The hemp filler sheets were dried. The aqueous portion originating from hemp plant (so called "extracts") was concentrated in an evaporator to a solid concentration of 50% and then coated on the reconstituted sheet using a size press at various levels and later dried:

- Sample E: Hemp filler as described above, with no addition of hemp extracts
- Sample A: Sample E with addition by coating of 3% of vegetal glycerine and 29% of hemp extracts, which is the soluble content of conventional hemp plant used as the starting material.
- Sample B: Sample E with an addition by coating of 15% of vegetal glycerine and 25% of hemp extracts Smoking Evaluation:

Sample E is evaluated in conventional cigarettes. Very nice smoke volume. Good combustion/free burn rate. Light bitterness on the tongue as well as a light irritation. Rather neutral Sample A is evaluated in conventional cigarettes. Very nice smoke volumes. Very nice and intensive cannabis taste. No irritation. Addition of hemp extracts and a bit of vegetal glycerine improve the smoking experience by improving taste and containing the irritation.

Sample B is evaluated in heat but not burn conditions (PAX3 device): Very nice smoke volumes. Good combustion and nice smell of cannabis. Nice herbal taste. Slightly higher bitterness. Long lasting taste.

Example 2

A hemp filler may be made according to the present disclosure comprising fibres originating from hemp (*Cannabis* spp) plant according to the following method: hemp leaves are ground using a knife mill so as to obtain particles about 1 mm in size. The ground hemp material is then mixed with water at 70° C. for 45 minutes, in a hemp/water ratio of 1/10. The mixture is then pressed so as to separate the aqueous part (hemp fluid) from the insoluble part (hemp fibres). The fibrous fraction is refined using disc refiners. After refining, delignified fibres originating from resinous trees are added to the refined fibre fraction in a ratio of delignified fibres/fibres from hemp plant of 15%/85% so as to manufacture hemp filler sheets. The hemp filler sheets are dried. The aqueous portion originating from hemp plant (so called "extracts") is concentrated in an evaporator to a solid concentration of 50% and then coated on the reconstituted sheet using a size press at various levels and later dried:

- Sample A: Hemp filler as described above, with no addition of hemp extracts
- Sample B: Sample A with addition by coating of 3% of vegetal glycerine and 26% of hemp extracts, which is the soluble content of conventional hemp leaves used as the starting material.
- Sample C: Sample A with an addition by coating of 15% of vegetal glycerine and 25% of hemp extracts Example 3

A hemp filler may be made according to the present disclosure comprising fibres originating from hemp (*Cannabis* spp) plant according to the following method: hemp leaves are ground using a knife mill so as to obtain particles about 1 mm in size. The ground hemp material is then mixed with water at 70° C. for 45 minutes, in a hemp/water ratio of 1/10. The mixture is then pressed so as to separate the aqueous part (hemp fluid) from the insoluble part (hemp fibres). The fibrous fraction is refined using disc refiners. After refining, delignified fibres originating from resinous trees are added to the refined fibre fraction in a ratio of delignified fibres/fibres from hemp plant of 15%/85% so as to manufacture hemp filler sheets. The hemp filler sheets are dried. The aqueous portion originating from hemp plant (so called "extracts") is concentrated in an evaporator to a solid concentration of 50% and then coated at a ratio of 26% on reconstituted sheet using a size press and later dried.

Various other substances are then added to the hemp filler sheets by coating and/or spraying. Substances that can be applied to the hemp filler sheet include aromas (flavorants), CBD, THC, and the like.

Example 4

A hemp filler may be made according to the present disclosure comprising fibres originating from hemp (*Cannabis* spp) plant according to the following method: hemp leaves are ground using a knife mill so as to obtain particles about 1 mm in size. The ground hemp material is then mixed with water at 70° ° C. for 45 minutes, in a hemp/water ratio of 1/10. The mixture is then pressed so as to separate the aqueous part (hemp fluid) from the insoluble part (hemp fibres). The fibrous fraction is refined using disc refiners. After refining, delignified fibres originating from resinous trees are added to the refined fibre fraction in a ratio of delignified fibres/fibres from hemp plant of 15%/85% so as to manufacture hemp filler sheets. The hemp filler sheets are dried.

In parallel, the aqueous portion prepared as above, and originating from Tobacco plant (tobacco fluid), also called tobacco "extracts" is concentrated in an evaporator to a solid concentration of 50% to be then coated on hemp filler sheet by coating with a size press, before being dried. Some reconstituted tobacco material is also manufactured according to the same methodology for the purpose of demonstration.

The following samples are demonstrative:

| | |
|---|---|
| A | 55% Hemp filler + 30% Tobacco extract + 15% glycerin |
| B | Control – 55% Tobacco fibers + 30% Tobacco extract + 15% glycerin |
| C | 60% Hemp filler + 40% Tobacco extract |
| D | Control – 60% Tobacco fibers + 40% Tobacco extract |

Example 5

A Hemp and tobacco filler may be made according to the present disclosure comprising fibres originating from hemp (*Cannabis* spp) plant and tobacco (Nicotania *tabacum*) plant according to the following method: hemp leaves and tobacco leaves are ground using a knife mill so as to obtain particles about 1 mm in size. The ground hemp and tobacco material are mixed at a ratio of 50%/50% and then mixed with water at 70° ° C. for 45 minutes, in a material/water ratio of 1/10. The mixture is then pressed so as to separate the aqueous part (mix of hemp and tobacco fluid) from the insoluble part (mix of hemp and tobacco fibres). The fibrous fraction is refined using disc refiners. After refining, delignified fibres originating from resinous trees and mix of tobacco and hemp fibres prepared as above are added to the refined fibre fraction in a ratio of delignified fibres/mix of tobacco and hemp fibres of 15%/85% so as to manufacture hemp and tobacco filler sheets. The hemp and tobacco filler sheets are then dried. The aqueous portion originating from hemp and tobacco plant (so called "extracts") is concentrated in an evaporator to a solid concentration of 50% and then coated at a desired ratio using a size-press and later dried. The following samples are demonstrative:

| | |
|---|---|
| A | 55% Hemp & tobacco filler + Hemp & Tobacco extract + 15% glycerin |
| B | 55% Hemp & tobacco filler + Hemp & Tobacco extract + 3% glycerin |

Example 6

Various raw materials were collected in order to produce a reconstituted plant material in accordance with the present disclosure. The first cannabis sample obtained was in a virgin state. In addition, two different sources of cannabis extracted byproducts were collected for producing samples. The samples used in this example are as follows:

Sample No. 1: A cannabis extracted byproduct that was in the form of a very fine particle size and was very homogeneous. The cannabis extracted byproduct was the product of an extraction process using supercritical carbon dioxide. The level of hot water solubles contained in the sample was measured at 37% by weight.

Sample No. 2: A mixture of cannabis leaves, stems, seed shells, hurds and flowers that was not pre-extracted. The level of hot water solubles was measured at 14% by weight.

Sample No. 3: A cannabis extracted byproduct containing small leaves, flowers and small stems. The cannabis extracted byproduct was pre-extracted with ethanol. The level of hot water solubles was measured at 27% by weight.

Each of the above samples were combined with 30% by weight hemp pulp.

Raw materials were extracted following the parameters hereunder:

250 g of raw materials, 1 extraction of 20 minutes at 70° C. (158° F.), pressing of the pulp to get the strong extracted liquor (SEL), 1 extraction of 10 minutes at 70° C., pressing of the pulp to get the light extracted liquor.

The extraction is done using a casserole and a hot plate. The temperature is controlled with a temperature sensor and set with the converter of the hot plate.

A cider press was used to separate the fibers and the liquor.

The refining was done with a PFI mill.

The standard procedure to prepare samples was:

1) Weigh out appropriate amount of air dry fiber (typically 24 g air dry will equal 22.5 g dry fiber).
2) Bring up to appropriate consistency with 200 ml $H_2O$ (typically around 10%).
3) Add hydrated pulp to laboratory blender and bring volume to 32 oz. (~950 ml).
4) Run blender at 50% Powerstat setting for 2 minutes.
5) Dewater with Buchner style funnel and filter screen; place the sample on the wire of a handsheets molder and press the pulp manually.
6) Place dewatered sample in tared appropriately sized container and bring to 225±1 grams with water.
7) Mix additional water into sample.

Sample Nos. 2 and 3 were then placed in the bowl of the PFI and applied 7000 revolutions.

The refined hemp pulp and raw material were mixed together using a blender. Ten handsheets of each sample were produced.

The extract from each sample was concentrated. Concentration of the liquors was done with a vacuum rotary evaporator (Rotavap). The steam was condensed with water at around 20° C. (68°F). The hot bath was set at 60° C. (140° F.). Liquors were concentrated at around 24% Brix.

After being concentrated, the extracts were applied to each of the reconstituted material samples. In addition, 1.5% by weight of glycerol (humectant) was added to each sample.

For Sample No. 1, extract was applied in an amount of 30.15% by weight, for Sample No. 2, extract was applied in an amount of 18.2% by weight, and for Sample No. 3, extract was applied in an amount of 25.7% by weight. The extract was applied to each sample using a manual size press. Each sample base sheet was cut in four pieces, coated, and dried at 110° ° C. for 4 minutes.

The treated samples were then cut using a conventional shredding device. The resulting cannabis reconstituted material filler was then fed into a lab scale cigarette making machine. It was observed that each sample ran perfectly on the machine and produced cannabis cigarettes of excellent quality that included an outer wrapper and a filter.

As demonstrated and described above, various different embodiments can be produced in accordance with the present disclosure. Further, each embodiment can be combined to produce new embodiments. In an embodiment, for instance, the present disclosure is directed to an aerosol generating material comprising a reconstituted cannabis material combined with web building fibers. The reconstituted cannabis material can comprise extracted cannabis fibers. The extracted cannabis fibers can come from numerous sources such as cannabis leaves, cannabis herds, cannabis buds, cannabis flowers, or mixtures thereof. The reconstituted cannabis material can also contain extracted cannabis stalk, seeds, and/or cannabis residue. The reconstituted cannabis material can be formed exclusively from virgin materials, can be formed from cannabis extracted byproducts that have undergone an additional water soluble extraction and/or can be formed from a combination of both. The reconstituted cannabis material can also be formed from cannabis plant material containing less than 0.3% by weight tetrahydrocannabinol, can be formed from cannabis plant material containing greater than 0.3% by weight tetrahydrocannabinol or can be formed from a mixture of both.

In an embodiment, the reconstituted cannabis material includes from about 20% to about 50% by weight extracted cannabis leaves, from about 20% to about 50% by weight extracted cannabis buds and/or flowers, and from about 3% to about 35% by weight delignified cellulosic fibers.

Any embodiment of the reconstituted cannabis material described above can be treated with water soluble cannabis components. The water soluble cannabis components can be obtained by extracting the cannabis fibers. The water soluble cannabis components, if desired, can be concentrated and then reapplied to the reconstituted cannabis material. In an embodiment, the reconstituted cannabis material contains water soluble cannabis components in an amount less than about 10% by weight, such as in an amount less than about 5% by weight. In an alternative embodiment, the reconstituted cannabis material contains water soluble cannabis components in an amount from about 10% by weight to about 60% by weight.

The web building fibers combined with the reconstituted cannabis material in any of the embodiments described above can vary. In an embodiment, the web building fibers are pulp fibers, such as softwood fibers, hardwood fibers, or mixtures thereof. In an embodiment, the web building fibers contain softwood fibers and hardwood fibers in a ratio of from 1:2 to 2:1. In an embodiment, the web building fibers comprise flax fibers. In an embodiment, the web building fibers are abaca fibers. In an embodiment, the web building fibers are bamboo fibers. In an embodiment, the web building fibers are coconut fibers. In an embodiment, the web building fibers are ramie fibers. In an embodiment, the web building fibers are jute fibers. In an embodiment, the web building fibers are hemp pulp fibers. The hemp pulp fibers can be used alone or in combination with wood pulp fibers, such as softwood fibers, hardwood fibers, or mixtures thereof. In an embodiment, the web building fibers are present in the aerosol generating material in an amount greater than about 5% by weight. In an embodiment, the web building fibers are present in the aerosol generating material in an amount greater than 8% by weight. In an embodiment, the web building fibers are present in the aerosol generating material in an amount greater than about 15% by weight. In an embodiment, the web building fibers are present in the aerosol generating material in an amount greater than about 20% by weight. In an embodiment, the web building fibers are present in the aerosol generating material in an amount greater than about 25% by weight. In an embodiment, the web building fibers are present in the aerosol generating material in an amount less than about 50% by weight, such as in an amount less than about 40% by weight.

Various other components can be added to any of the embodiments of the aerosol generating material described above. For example, the aerosol generating material can also contain extracted cocoa husk fibers combined with extracted cannabis fibers and web building fibers. The extracted cocoa husk fibers can be present in the reconstituted cannabis material in an amount greater than about 10% by weight, such as in an amount greater than about 20% by weight, and generally in an amount less than 80% by weight, such as less than about 40% by weight.

In an embodiment, the reconstituted cannabis material can be mixed with a dried cannabis material that has not been fed through an extraction process.

In an embodiment, the aerosol generating material can include an aerosol delivery composition applied to the reconstituted plant material. The aerosol delivery composition contains an aerosol delivery agent. In an embodiment, the aerosol delivery agent comprises a drug or a flavorant. The aerosol delivery composition can be an oil, an aqueous solution, an aqueous dispersion, or a solid in any of the embodiments described herein. In an embodiment, the aerosol delivery agent comprises nicotine. In an embodiment, the aerosol delivery agent comprises a cannabinoid. In an embodiment, the aerosol delivery agent comprises tetrahydrocannabinol. In an embodiment, the aerosol delivery agent comprises cannabidiol. In an embodiment, the aerosol delivery agent comprises a combination of tetrahydrocannabinol and cannabidiol. Nicotine or a cannabinoid can also be combined with other aerosol delivery agents. In an embodiment, the other aerosol delivery agent is sugar. In an embodiment, the other aerosol delivery agent comprises a licorice extract. In an embodiment, the other aerosol delivery agent comprises honey. In an embodiment, the other aerosol delivery agent comprises coffee. In an embodiment, the other aerosol delivery agent comprises maple syrup. In an embodiment, the other aerosol delivery agent comprises a plant extract, such as a tea extract or a botanical extract. In an embodiment, the other aerosol generating agent comprises a tobacco extract. In an embodiment, the aerosol delivery agent comprises a tobacco extract alone. In an embodiment, the aerosol delivery composition contains a terpene or a blend of terpenes. A terpene or a blend of terpenes can be used with any of the aerosol delivery agents described above including nicotine or a cannabinoid.

The aerosol delivery composition containing one or more aerosol delivery agents can be present in the reconstituted cannabis material in an amount greater than about 1% by weight. In an embodiment, one or more aerosol delivery agents are present in an amount greater than about 3% by weight, such as in an amount greater than about 5% by weight. One or more aerosol delivery agents can be present on the reconstituted cannabis material in any of the embodiments described above in an amount less than about 50% by weight, such as in an amount less than about 25% by weight.

In any of the embodiments described above, the reconstituted cannabis material can have a basis weight of from about 40 gsm to about 120 gsm. The aerosol generating material can be tobacco-free or can contain a tobacco, whether flue cured, reconstituted, or both.

In an embodiment, the aerosol generating material can include a humectant. The humectant can be applied to any of the reconstituted plant material embodiments described above. The humectant can be glycerol, propylene glycol, or a combination of glycerol and propylene glycol. In an embodiment, the humectant is present in an amount of about 5% by weight or less. In an embodiment, the humectant is present in an amount of about 10% by weight or greater and in an amount of about 50% or less.

In any of the embodiments described above, the reconstituted material can include a burn control agent. The burn control agent can comprise a salt of a carboxylic acid, such as a citrate or a succinate. In any of the embodiments described above, the reconstituted material can be treated with a burn retardant alone or in combination with the burn control agent.

In any of the embodiments described above, the aerosol generating material can be in the form of a filler material comprising a strip, strips, shreds, or mixtures thereof. In any of the embodiments described above, the filler material can have a static burn rate of greater than 4 mm/mm, such as greater than 5 mm/mm. In any of the embodiments described above, the filler material can have a filling power of greater than 4 $cm^3/g$, such as greater than 5 $cm^3/g$, such as greater than 6 $cm^3/g$.

The aerosol generating material in any of the embodiments described above can be used in numerous different products. In an embodiment, the aerosol generating material of any of the above embodiments can be formed into a smokable rod surrounded by an outer wrapper to form a smoking article. The smoking article can optionally include a filter located at one end. Optionally, the wrapper can include a plurality of discrete reduced ignition areas.

In an embodiment, any of the aerosol generating materials described above can be used in a heat but not burn device.

In any of the aerosol generating material embodiments described above, the aerosol generating material can be used as a snuff product.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. An aerosol generating material comprising:

a reconstituted cannabis material comprising extracted cannabis fibers comprising cannabis leaves, cannabis hurds, cannabis buds, cannabis flowers, or mixtures thereof, the extracted cannabis fibers being combined with web building fibers, the web building fibers comprising delignified cellulose fibers; and an aerosol delivery composition applied to the reconstituted cannabis material, the aerosol delivery composition containing an aerosol delivery agent, wherein the aerosol delivery agent comprises nicotine, a cannabinoid, a tetrahydrocannabinol, a flavorant, or mixtures thereof.

2. An aerosol generating material as defined in claim 1, wherein the reconstituted cannabis material has been treated with a humectant.

3. An aerosol generating material as defined in claim 2, wherein the humectant comprises glycerol, propylene glycol or mixtures thereof.

4. An aerosol generating material as defined in claim 2, wherein the humectant is present in the reconstituted cannabis material in an amount of 5% by weight or less.

5. An aerosol generating material as defined in claim 2, wherein the humectant is present in the reconstituted cannabis material in an amount of about 10% by weight or greater, and in an amount of about 50% or less.

6. An aerosol generating material as defined in claim 1, wherein the reconstituted cannabis material includes from about 20% to about 50% by weight extracted cannabis leaves, from about 20% to about 50% by weight extracted cannabis buds and/or flowers, and from about 3% by weight to about 20% by weight delignified cellulosic fibers.

7. An aerosol generating material as defined in claim 1, wherein the reconstituted cannabis material is formed from cannabis plant material containing less than 0.3% by weight tetrahydrocannabinol.

8. An aerosol generating material as defined in claim 1, wherein the reconstituted cannabis material is formed at least partially from cannabis extracted byproducts that have undergone an additional water soluble extraction.

9. An aerosol generating material as defined in claim 1, wherein the aerosol delivery agent comprises the cannabinoid.

10. An aerosol generating material as defined in claim 1, wherein the aerosol delivery agent comprises the tetrahydrocannabinol.

11. An aerosol generating material as defined in claim 9, wherein the aerosol delivery agent comprises cannabidiol.

12. An aerosol generating material as defined in claim 1, wherein the aerosol delivery agent comprises the flavorant, the flavorant comprising a sugar, a licorice extract, honey, a coffee extract, maple syrup, a tea extract, a plant extract, a botanical extract, a tobacco extract, or a fruit extract.

13. An aerosol generating material as defined in claim 1, wherein the aerosol delivery composition comprises a blend of terpenes.

14. An aerosol generating material as defined in claim 1, wherein the aerosol delivery composition is present on the reconstituted cannabis material in an amount greater than about 1% by weight and less than about 50% by weight.

15. An aerosol generating material as defined in claim 1, wherein the reconstituted cannabis material contains water soluble cannabis components in an amount less than about 10% by weight.

16. An aerosol generating material as defined in claim 1, wherein the reconstituted cannabis material contains water soluble cannabis components in an amount from about 10% by weight to about 60% by weight.

17. An aerosol generating material as defined in claim 1, wherein the web building fibers comprise flax fibers, abaca fibers, softwood fibers, hardwood fibers, bamboo fibers, coconut fibers, ramie fibers, jute fibers, or mixtures thereof.

18. An aerosol generating material as defined in claim 1, wherein the web building fibers comprise hemp pulp fibers.

19. An aerosol generating material as defined in claim 1, wherein the web building fibers are present in the reconstituted cannabis material in an amount greater than about 3% by weight, and in an amount less than about 40% by weight.

20. An aerosol generating material as defined in claim 1, wherein the aerosol generating material is tobacco-free.

21. An aerosol generating material as defined in claim 1, wherein the reconstituted cannabis material has a basis weight of from about 40 gsm to about 120 gsm.

* * * * *